US008531102B2

(12) United States Patent
Takagi et al.

(10) Patent No.: US 8,531,102 B2
(45) Date of Patent: Sep. 10, 2013

(54) DISPLAY AND ELECTRONIC UNIT

(75) Inventors: Kazunari Takagi, Tokyo (JP); Tomoyuki Higo, Tokyo (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 13/470,895

(22) Filed: May 14, 2012

(65) Prior Publication Data

US 2012/0313509 A1 Dec. 13, 2012

(30) Foreign Application Priority Data

May 19, 2011 (JP) ..... 2011-112381
Feb. 21, 2012 (JP) ..... 2012-035312

(51) Int. Cl.
*H05B 33/00* (2006.01)

(52) U.S. Cl.
USPC ..... 313/504; 313/498; 313/500

(58) Field of Classification Search
USPC ..... 313/498–512
See application file for complete search history.

(56) References Cited

U.S. PATENT DOCUMENTS 6,911,773 B2 * 6/2005 Seki ..... 313/506
7,273,773 B2 * 9/2007 Yamazaki et al. ..... 438/158

FOREIGN PATENT DOCUMENTS

JP 09-167684 6/1997
JP 11-40065 2/1999
JP 11-96911 4/1999
JP 2002-216957 8/2002

* cited by examiner

*Primary Examiner* — Joseph L Williams
(74) *Attorney, Agent, or Firm* — Sheridan Ross P.C.

(57) ABSTRACT

A display includes: a display region including a plurality of pixels, a plurality of first liquid-repellent regions, and a plurality of first lyophilic regions, each of the plurality of first liquid-repellent regions being provided in a part or a whole of a portion between the plurality of pixels, and each of the plurality of first lyophilic regions being provided between the plurality of first liquid-repellent regions next to each other; and a peripheral region in a part or a whole of which a second lyophilic region is formed.

20 Claims, 21 Drawing Sheets

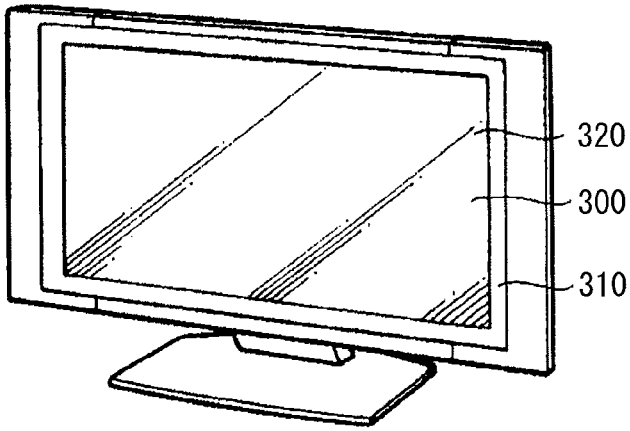
FIG. 23
FIG. 24A
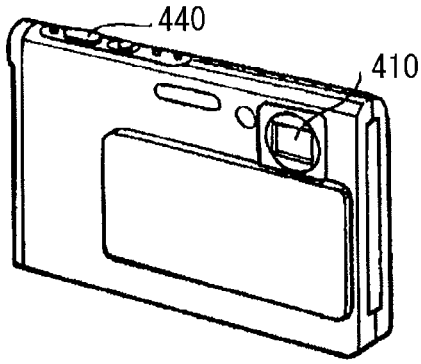
FIG. 24B
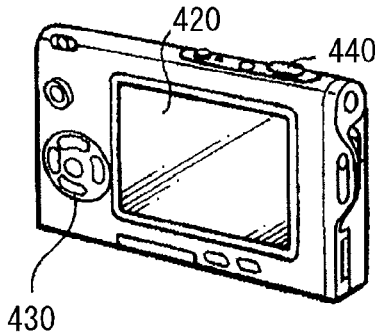

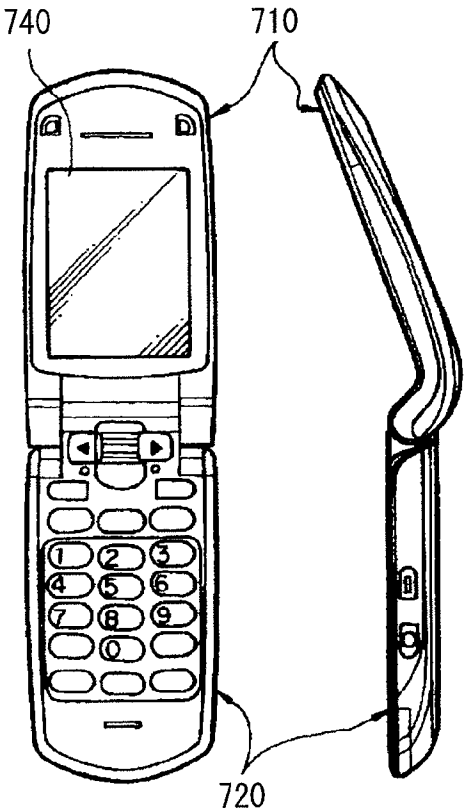
FIG. 27A
FIG. 27B
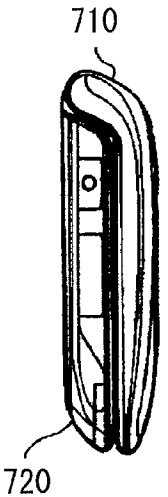
FIG. 27D
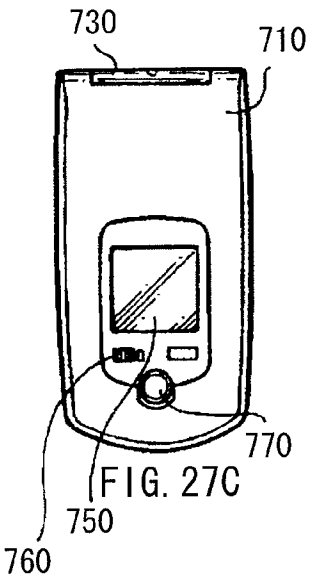
FIG. 27C
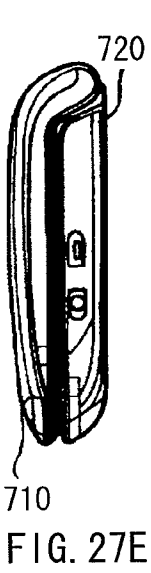
FIG. 27E
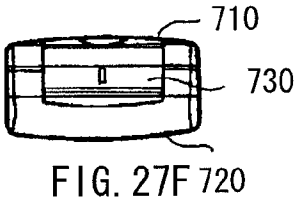
FIG. 27F
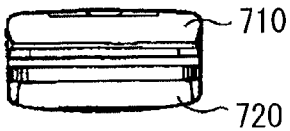
FIG. 27G

DISPLAY AND ELECTRONIC UNIT

BACKGROUND

The disclosure relates to a display emitting light using an organic Electro Luminescence (EL) phenomenon, and an electronic unit provided with this display.

High-performance display devices have been in demand as development of information and communication industry has been accelerated. Among the display devices is an organic EL device that has been attracting attention as a next-generation display device. The organic EL device has an advantage of having not only a wide viewing angle as well as excellent contrast, but also quick response time, to serve as a self-luminous-type display device.

The organic EL device has a configuration in which a plurality of layers are laminated. These layers are formed by, for example, vacuum deposition. Typically, there is a method of patterning a layer into a desired shape by interposing a mask with openings between an evaporation source and a substrate. In a case where a large organic EL device is formed using this method, it is necessary to employ a mask meeting the size of a substrate, namely, a large mask. As the mask increases in size, it becomes more flexible, and alignment becomes more difficult due to complication of transportation and the like, thereby decreasing an aperture ratio. For this reason, there has been a disadvantage of degradation in device characteristics. Also, material-utilization efficiency has been low.

Japanese Unexamined Patent Application Publication Nos. 1997-167684 and 2002-216957, for example, each disclose a method of producing a pattern with heat transfer printing. However, there is a disadvantage of a high cost for overall manufacturing equipment, because a laser is used as a heat source.

Meanwhile, for example, Japanese Unexamined Patent Application Publication Nos. H11-40065 and H11-96911 each disclose a method of producing a plasma display panel display. In this method, ink in which a fluorescent material or the like is dissolved in a solvent is dropped directly onto a pixel, and thereby a phosphor layer or a reflective layer is formed. Specifically, a plurality of openings (discharge openings) are provided in one head, and a plurality of lines are formed by one scan. Therefore, material utilization efficiency is high, and it is possible to form a phosphor layer, with an inexpensive unit configuration.

SUMMARY

However, it is difficult to apply each of the methods disclosed in Japanese Unexamined Patent Application Publication Nos. H11-40065 and H11-96911 to the organic EL device, for the following reason. In the plasma display panel display, a pitch between the openings is large, and a viscosity of the ink is high. Therefore, the phosphor layer is readily patterned, concurrently with discharge of a droplet. In contrast, as for the organic electroluminescence display, a pitch between openings is small, and moreover, ink in which an organic material is dissolved has a low viscosity as well as a low contact angle, and therefore, wettability is high. Hence, unlike the ink for the plasma display, it is difficult to perform patterning concurrently with discharge.

It is desirable to provide a display whose device characteristics may be improved with simple production, and an electronic unit provided with this display.

According to an embodiment of the present technology, there is provided a display including a display region and a peripheral region. The display region includes a plurality of pixels, a plurality of first liquid-repellent regions, and a plurality of first lyophilic regions. Each of the plurality of first liquid-repellent regions is provided in a part or a whole of a portion between the plurality of pixels. Each of the plurality of first lyophilic regions is provided between the plurality of first liquid-repellent regions next to each other. In a part or a whole of the peripheral region, a second lyophilic region is formed.

According to an embodiment of the present technology, there is provided an electronic unit including a display, the display including: a display region including a plurality of pixels, a plurality of first liquid-repellent regions, and a plurality of first lyophilic regions, each of the plurality of first liquid-repellent regions being provided in a part or a whole of a portion between the plurality of pixels, and each of the plurality of first lyophilic regions being provided between the plurality of first liquid-repellent regions next to each other; and a peripheral region in a part or a whole of which a second lyophilic region is formed.

In the display and the electronic unit according to the above-described embodiments of the present technology, the plurality of first liquid-repellent regions and the plurality of first lyophilic regions are provided in the display region, and the second lyophilic region is provided in a part or a whole of the peripheral region. Each of the plurality of first liquid-repellent regions is provided in a part or a whole of the portion between the plurality of pixels, and each of the plurality of first lyophilic regions is provided between the plurality of first liquid-repellent regions next to each other. Therefore, it is possible to perform patterning of an organic layer in a simple way.

According to the display and the electronic unit in the above-described embodiments of the present technology, the plurality of first liquid-repellent regions and the plurality of first lyophilic regions are provided in the display region including the plurality of pixels. Each of the plurality of first liquid-repellent regions is provided in a part or a whole of the portion between the plurality of pixels, and each of the plurality of first lyophilic regions is provided between the plurality of first liquid-repellent regions next to each other. Further, the second lyophilic region is provided in a part or a whole of the peripheral region. Therefore, it is possible to perform the patterning of the organic layer in a simple way. This improves device characteristics. In other words, it is possible to provide a full color display with stable characteristics, in a simple way.

It is to be understood that both the foregoing general description and the following detailed description are exemplary, and are provided to provide further explanation of the technology as claimed.

BRIEF DESCRIPTION OF THE DRAWINGS

The accompanying drawings are included to provide a further understanding of the disclosure, and are incorporated in and constitute a part of this specification. The drawings illustrate embodiments and, together with the specification, serve to explain the principles of the technology.

FIG. 16A is a perspective diagram, and FIGS. 16B and 16C are cross-sectional diagrams.

FIG. 23 is a perspective diagram illustrating an appearance of an application example 1.

FIGS. 24A and 24B are perspective diagrams of an application example 2, namely, FIG. 24A illustrates an appearance when viewed from a front side, and FIG. 24B illustrates an appearance when viewed from a back side.

FIGS. 27A to 27G are views of an application example 5, namely, a front view in an open state, a side view in the open state, a front view in a closed state, a left-side view, a right-side view, a top view, and a bottom view, respectively.

DETAILED DESCRIPTION OF EMBODIMENTS

Embodiments of the disclosure will be described below in detail with reference to the drawings. It is to be noted that the description will be provided in the following order.

1. First embodiment (a display having first lyophilic regions and first liquid-repellent regions in a display region, and a second lyophilic region in a peripheral region)
1-1. Patterning method
1-2. Overall configuration of display
2. Second embodiment (a display having a second liquid-repellent region in a peripheral region)
3. Third embodiment (a display in which first lyophilic regions and a second lyophilic region are continuous with each other)
4. Fourth embodiment (a display in which first lyophilic regions and a second lyophilic region are continuous with each other, and which has a narrow region at one end of the first liquid-repellent regions)
5. Fifth embodiment (a display having first liquid-repellent regions each having a region width changing along a longitudinal direction)
6. Sixth embodiment (a display having first liquid-repellent regions in which projections and depressions are formed along a longitudinal direction)
7. Seventh embodiment (a display in which first lyophilic regions with intervals varying among pixels are formed)
8. Eighth embodiment (a display in which first liquid-repellent regions and first lyophilic regions are formed of the same material)
9. Modification (a display in which a connection section between a cathode electrode and auxiliary wiring is provided in each of first liquid-repellent regions)
10. Application examples

1. First Embodiment (1-1. Patterning Method)

Figure 1:
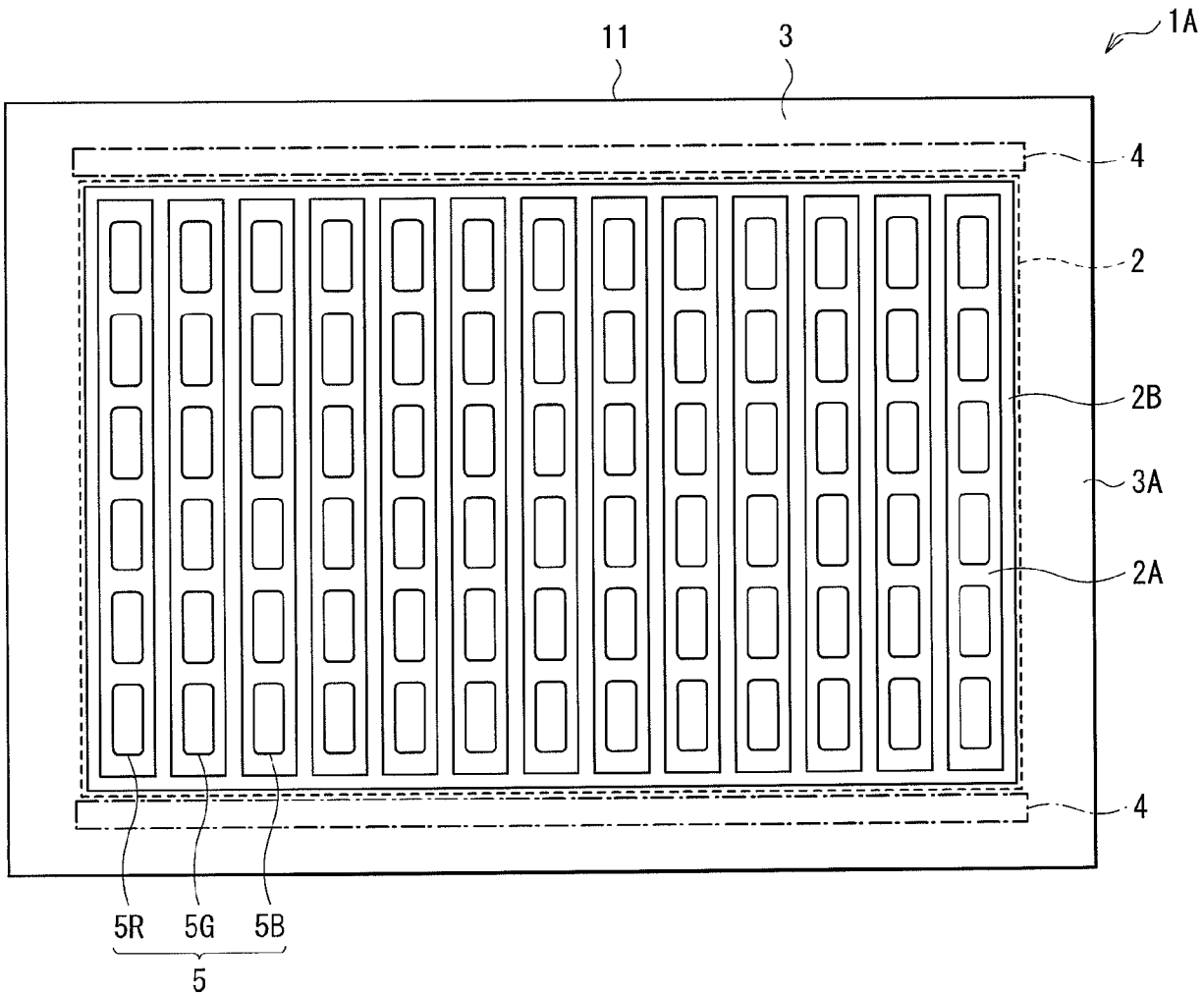
FIG. 1 is a plan view illustrating a configuration of a display according to a first embodiment of the disclosure.

FIG. 1 illustrates a plane configuration of each of a display region 2 and a peripheral region 3 in a display 1A according to the first embodiment of the disclosure. In this display 1A, for example, a plurality of pixels 5 are arranged in a matrix (grid) on a substrate 11, as the display region 2. The plurality of pixels 5 are, for example, red pixels 5R, green pixels 5G, and blue pixels 5B, and arranged in lines for each color. These pixels 5 (5R, 5G, and 5B) are provided with organic EL devices 10 (10R, 10G, and 10B) of corresponding colors, respectively. It is to be noted that here, the red pixel 5R, the green pixel 5G, and the blue pixel 5B combined form one display pixel (pixel).

The display region 2 of the display 1A in the present embodiment are provided with first liquid-repellent regions 2B and first lyophilic regions 2A, which divide the plurality of pixels 5R, 5G, and 5B for each color, and are provided around the plurality of pixels arranged in the matrix. The first lyophilic regions 2A are formed in a region excluding the first liquid-repellent regions 2B. To be more specific, each of the first lyophilic regions 2A is formed to surround the plurality of pixels 5R, 5G, and 5B provided in the display region 2, and the first liquid-repellent regions 2B are formed to divide the pixels 5R, 5G, and 5B on the first lyophilic regions 2A for each color. The first lyophilic regions 2A and the first liquid-repellent regions 2B together have a function of serving as a bank of ink discharged when the organic EL devices 10 are formed by coating. A desired pixel pattern is formed by thus providing the lyophilic regions that are divided for each color by the liquid-repellent regions.

Each of the first lyophilic regions 2A is used to improve wettability of the ink, and provided continuously in the display region 2 to surround the pixels 5R, 5G, and 5B as described above. As a material of the first lyophilic regions 2A, there is used an inorganic material, e.g., silicon dioxide ($SiO_2$), silicon carbide (SiC), silicon nitride ($Si_3N_4$), indium tin oxide (ITO), indium zinc oxide (IZO), aluminum (Al), titanium (Ti), molybdenum (Mo), or the like. The first lyophilic regions 2A are formed by vacuum deposition, CVD (Chemical Vapor Deposition), PVD (Physical Vapor Deposition), or the like.

The first liquid-repellent regions 2B are provided to prevent excessive wet spread of the ink discharged onto each of the pixels 5R, 5G, and 5B lines, specifically, entrance of the link into the adjacent pixel lines. As described above, the first liquid-repellent regions 2B are provided to divide the pixels 5R, 5G, and 5B for each color, and surround the pixels as a whole. Examples of a material of the first liquid-repellent regions 2B include organic materials such as polyimide and novolak. Any of these materials is formed into a predetermined shape, and subsequently subjected to a plasma treatment, and thereby liquid repellency is added thereto.

Further, a second lyophilic region 3A is provided in a part or a whole, here a whole, of the peripheral region 3 in the display 1A of the present embodiment. Improving wettability of the peripheral region by providing the second lyophilic region 3A makes it easy to form a liquid bead at the time of discharging the ink on each pixel line. This allows continuous discharge of the ink on the pixel lines. It is to be noted that the second lyophilic region 3A is not limited to this, and may be provided on at least one end side of the pixels 5R, 5G, and 5B arranged in lines for each color. Specifically, a bead formation region 4 formed upon starting ink application may be provided as the second lyophilic region, for a reason to be described later. However, there is also a case where the second lyophilic region 3A is provided at each of both ends to form a symmetric pattern, which is advantageous in or after a production process of an organic layer 15. It is to be noted that this second lyophilic region 3A is formed using the same material by the same method as those of the first lyophilic regions 2A.

The organic EL devices 10 (10R, 10G, and 10B) of the colors corresponding to the pixels 5R, 5G, and 5B, respectively, as described above are provided on the pixels 5R, 5G, and 5B of the display region 2. As will be described later in detail, this organic EL device 10 has a configuration in which an anode electrode 12 (first electrode), a partition wall 14, the organic layer 15, and a cathode electrode 16 (second electrode) are laminated in this order (see FIG. 5). Of these, a part of the organic layer 15 is formed by a coating method such as a droplet discharge method. Specifically, the ink, in which an organic material of the organic layer 15 is dissolved in an organic solvent, is arranged on each of the pixels 5R, 5G, and 5B, by being discharged from a plurality of discharge openings provided in a head of a slit coater (or a stripe coater). Subsequently, the solvent is removed by heating, and thereby each layer is formed. The ink with the dissolved organic material used in the present embodiment has a low viscosity as well as a low contact angle and thus has high wettability. For this reason, the ink after being discharged is spread on the display region 2 or the peripheral region 3, which reduces reliability of the substrate remarkably. Further, it is difficult to perform patterning, and furthermore, it is difficult to control a film thickness of each of the color pixels 5R, 5G, and 5B.

Figure 2A:
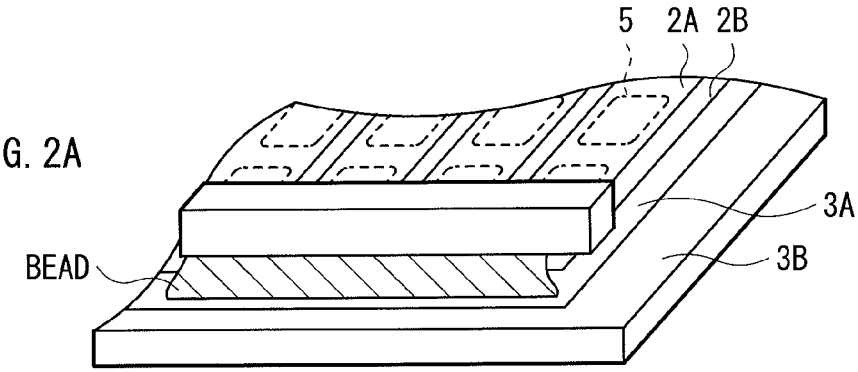
FIGS. 2A to 2C are schematic diagrams used to explain a formation method of the display illustrated in FIG. 1.
Figure 2B:
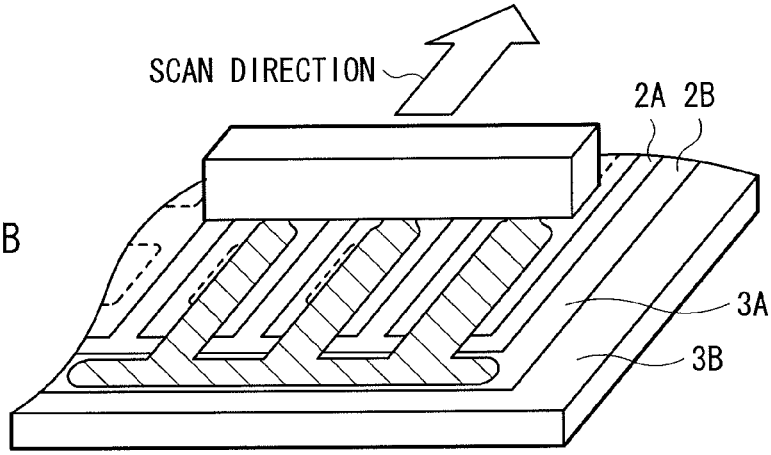
Figure 2C:
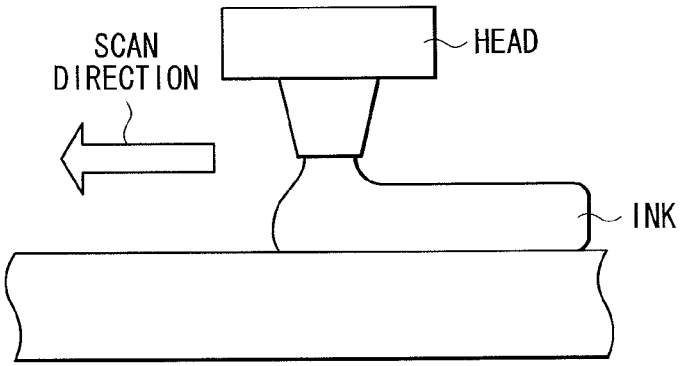

The organic layer 15 is formed as follows. First, as illustrated in FIG. 2A, the ink is discharged from the discharge openings of the head of the slit coater, onto outside of the first liquid-repellent regions 2B, in particular, onto the peripheral region 3 on one-end side of the pixels 5 disposed for each color. Thereby, the bead is formed so that the head contacts the substrate 11 via the ink. This allows wettability of a head surface to become uniform. Next, as illustrated in FIG. 2B, a scan is performed along surfaces of the pixel lines, thereby discharging the ink onto the pixels 5. At the time, as illustrated in FIG. 2C, the head moves in a scanning direction while maintaining a state of contacting the substrate 11 via the ink.

In formation of the organic layer 15 by such a coating method, formation of the bead is important. For this reason, in the peripheral region 3 surrounding the display region 2, it is desirable to provide the second lyophilic region 3A in at least the bead formation region 4 as described above. In the present embodiment, the second lyophilic region 3A is provided on the entire peripheral region 3. This suppresses disconnection between the ink and the substrate 11 due to surface tension of the ink or liquid repellency of the substrate 11, making it easy to maintain connection between the ink and the substrate 11. In other words, it is possible to perform accurate formation of the organic layer 15 by coating, in each of the color pixels 5R, 5G, and 5B.

(1-2. Overall Configuration of Display)

Figure 3:
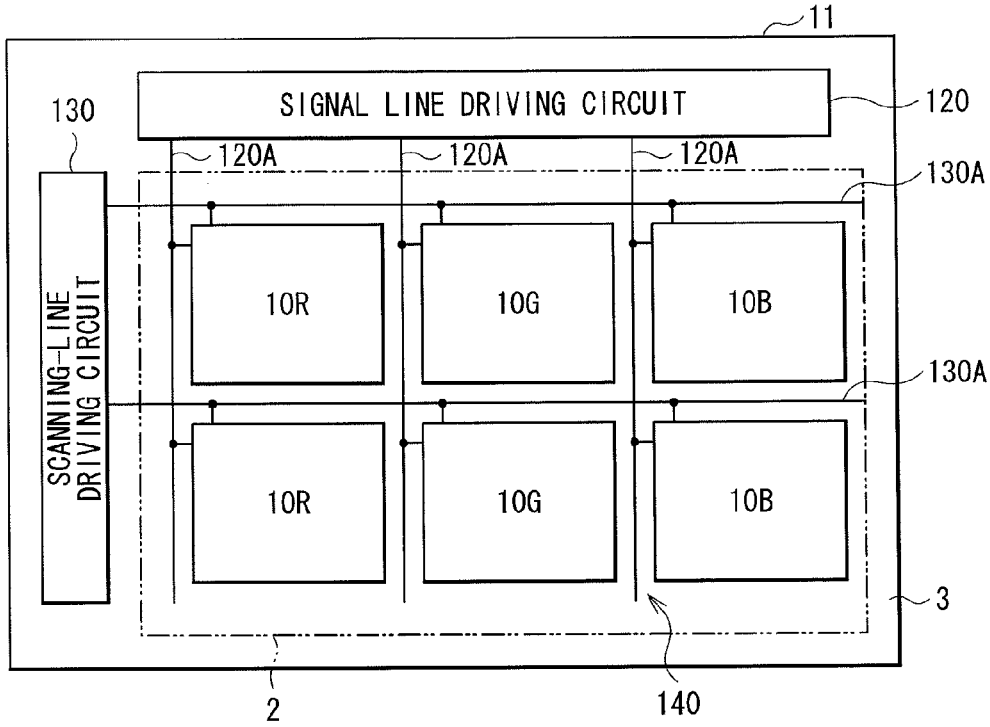
FIG. 3 is a schematic diagram of the display illustrated in FIG. 1.

Next, an overall configuration of the display 1A will be described. FIG. 3 illustrates a schematic configuration of the display 1A of the present embodiment. This display 1A is used as an organic EL television unit or the like. As described above, the display region 2 in which the plurality of organic EL devices 10R, 10G, and 10B are arranged in the matrix is formed on the substrate 11, and the peripheral region 3 is provided to surround the display region 2. The peripheral region 3 is provided with a signal-line driving circuit 120 and a scanning-line driving circuit 130 which are drivers for image display.

Figure 4:
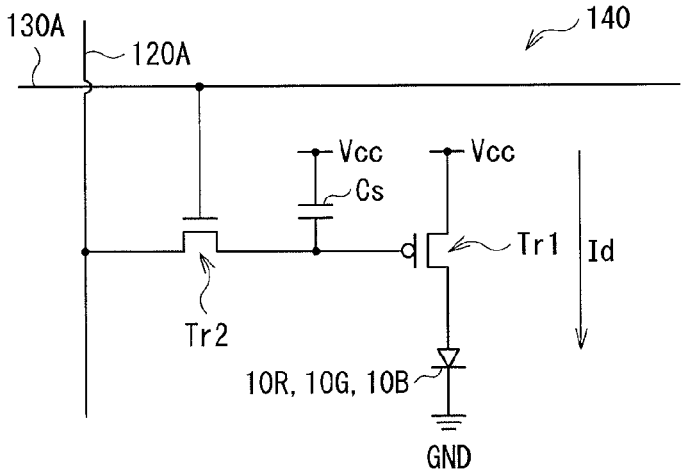
FIG. 4 is a diagram illustrating an example of a pixel driving circuit of the display depicted in FIG. 3.

Within the display region 2, a pixel driving circuit 140 is provided. FIG. 4 illustrates an example of the pixel driving circuit 140. The pixel driving circuit 140 is an active-type driving circuit formed at a layer below the anode electrode 12 which will be described later. In other words, this pixel driving circuit 140 has a drive transistor Tr1 as well as a write transistor Tr2, a capacitor (a retention capacitor) Cs between these transistors Tr1 and Tr2, and the red organic EL device 10R (or the green organic EL device 10G, or the blue organic EL device 10B). The red organic EL device 10R is connected to the drive transistor Tr1 in series between a first power supply line (Vcc) and a second power supply line (GND). The drive transistor Tr1 and the write transistor Tr2 are each configured using a typical thin film transistor (TFT), and a configuration thereof is not limited in particular, and may be of, for example, a staggered structure (a so-called bottom-gate type), or an inverted staggered structure (a top-gate type).

In the pixel driving circuit 140, a plurality of signal lines 120A are arranged in a column direction, and a plurality of scanning lines 130A are arranged in a row direction. An intersection of each of the signal lines 120A with each of the scanning lines 130A corresponds to any of the red organic EL device 10R, the green organic EL device 10G, and the blue organic EL device 10B. Each of the signal lines 120A is connected to the signal-line driving circuit 120, and an image signal is supplied from this signal-line driving circuit 120 to a source electrode of the write transistor Tr2 through the signal line 120A. Each of the scanning lines 130A is connected to the scanning-line driving circuit 130, and a scanning signal is sequentially supplied from this scanning-line driving circuit 130 to a gate electrode of the write transistor Tr2 through the scanning line 130A.

Further, in the display region 2, the red organic EL device 10R producing red light, the green organic EL device 10G producing green light, and the blue organic EL device 10B producing blue light are sequentially arranged in a matrix as a whole, as described above.

Figure 5:
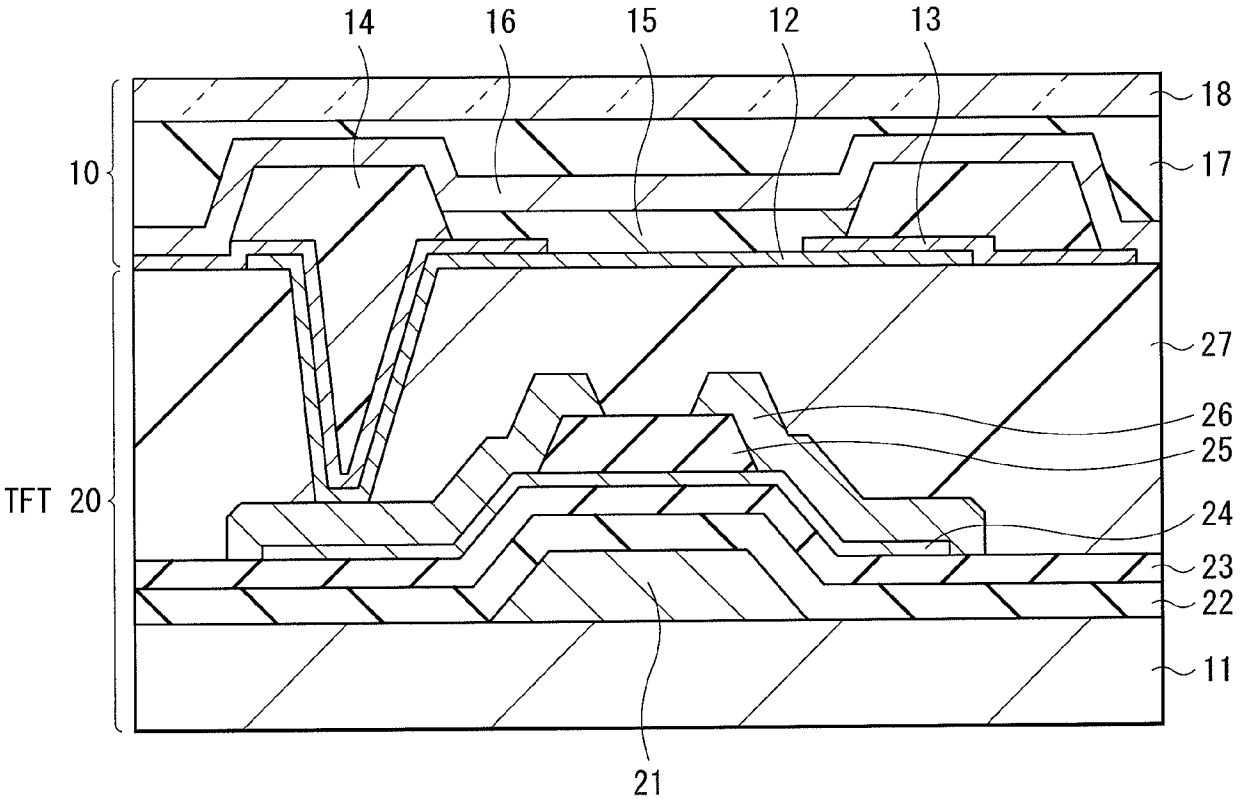
FIG. 5 is a cross-sectional diagram of the display illustrated in FIG. 1.

FIG. 5 illustrates an example of a cross-sectional configuration of the display 1A in the display region 2. In the display 1A, a TFT 20 is provided to drive the pixel 5 on the substrate 11 based on, for example, an active matrix system. On the TFT 20, the organic EL device 10 (10R, 10G, and 10B) of the pixel 5 (5R, 5G, and 5B) is provided.

(TFT)

The TFT 20 is a so-called bottom-gate-type TFT, and, for example, an oxide semiconductor is used for a channel (an active layer). In this TFT 20, a gate electrode 21, gate insulating films (a first gate insulating film 22 and a second gate insulating film 23), an oxide semiconductor layer 24, a channel protective film 25, and a source-drain electrode 26 are formed in this order on the substrate 11 made of glass or the like. On the source-drain electrode 26, a flattening layer 27 used to flatten projections and depressions of the TFT 20 is formed over the entire surface of the substrate 11.

The gate electrode 21 plays a role in controlling a carrier density (here, an electron density) in the oxide semiconductor layer 24, by using a gate voltage applied to the TFT 20. This gate electrode 21 is configured using, for example, a single layer film made of one kind, or a laminated film made of two or more kinds, of Mo, Al, aluminum alloys, and the like. It is to be noted that examples of the aluminum alloys include an aluminum-neodymium alloy.

The first gate insulating film 22 and the second gate insulating film 23 are formed of a single layer film made of one kind, or a laminated film made of two or more kinds, of $SiO_2$, $Si_3N_4$, silicon nitride oxide (SiON), aluminum oxide ($Al_2O_3$), and the like. Here, the first gate insulating film 22 and the second gate insulating film 23 are in a two-layer structure. The insulating films 22 and 22 are configured using, for example, a $SiO_2$ film and a $Si_3N_4$ film, respectively. A total film thickness of the gate insulating films 22 and 23 is, for example, about 200 nm to about 300 nm both inclusive.

The oxide semiconductor layer 24 contains, as a main component, one or more kinds of oxide, among oxides of indium (In), gallium (Ga), zinc (Zn), tin (Sn), Al, and Ti, for example. This oxide semiconductor layer 24 forms a channel in the source-drain electrode 26 by applying a gate voltage. It is preferable that a film thickness of this oxide semiconductor layer 24 be on a level of not causing deterioration in an ON-state current of the thin-film transistor, so that an influence of negative charge to be described later is exerted upon the channel. Specifically, the film thickness is desirably about 5 nm to about 100 nm both inclusive.

The channel protective film 25 is formed on the oxide semiconductor layer 24, and prevents damage to the channel at the time when the source-drain electrode 26 is formed. A thickness of the channel protective film 25 is, for example, about 10 nm to about 300 nm both inclusive.

The source-drain electrode 26 is, for example, a single layer film made of one kind, or a laminated film made of two or more kinds, of Mo, Al, copper (Cu), Ti, ITO, TiO, and the like. For example, it is desirable to use a three-layer film in which Mo, Al, and Mo having film thicknesses of about 50 nm, about 50 nm, and about 500 nm, respectively, are laminated in this order. Alternatively, it is desirable to use a metal or a metal compound having a weak tie with oxygen, like a metal compound containing oxygen, such as ITO and titanium oxide. This makes it possible to stably maintain electrical properties of the oxide semiconductor.

For the flattening layer 27, an organic material such as polyimide or novolak is used, for example. A thickness of this flattening layer 27 is, for example, about 10 nm to about 100 nm both inclusive, and, preferably, about 50 nm or less. On the flattening layer 27, the anode electrode 12 of the organic EL device 10 is formed.

(Organic EL Device)

The organic EL device 10 is a top-emission-type display device that extracts light from a side (a side closer to the cathode electrode 15) opposite to the substrate 11. The light is produced when holes injected from the anode electrode 12 and electrons injected from the cathode electrode 16 recombine within a light-emitting layer 15C. Use of the organic EL device 10 of the top-emission type improves an aperture ratio of a light emission section of the display. It is to be noted that the organic EL device 10 of the disclosure is not limited to this configuration, and may be, for example, of a transmission type. In other words, the organic EL device 10 may be a bottom-emission-type display device that extracts the light from the substrate 11.

In the organic EL device 10, the anode electrode 12 made of a highly reflective material e.g. Al, Ti, or Cr is formed on the flattening layer 27, when the display 1A is of the top-emission type, for example. When the display 1A is of the transmission type, a transparent material e.g. ITO, IZO, or IGZO is used.

Here, formed on the anode electrode 12 and the flattening layer 27 excluding the organic layer 15 provided thereon is the first lyophilic region 2A for which $SiO_2$, $Si_3N_4$, or the like is used. In other words, here, a lyophilic layer 13 is formed. In a part of a region on this lyophilic layer 13, the first liquid-repellent region 2B used to pattern the organic layer 15 is formed. That is, here, a liquid-repellant layer 14 is formed. It is to be noted that this liquid-repellant layer 14 also has a role in securing insulation between the anode electrode 12 and the cathode electrode 16 to be described later, and generally functions as a partition wall. This liquid-repellant layer 14 is provided to surround an opening of the pixel 5, namely, a light emission region, and also provided on a connection section between the source drain electrodes 26 of the TFT 20 and the anode electrode 12. The liquid-repellant layer 14 is formed of the organic material such as polyimide or novolak as described above, and liquid repellency is added thereto by performing plasma oxidation.

Figure 6:
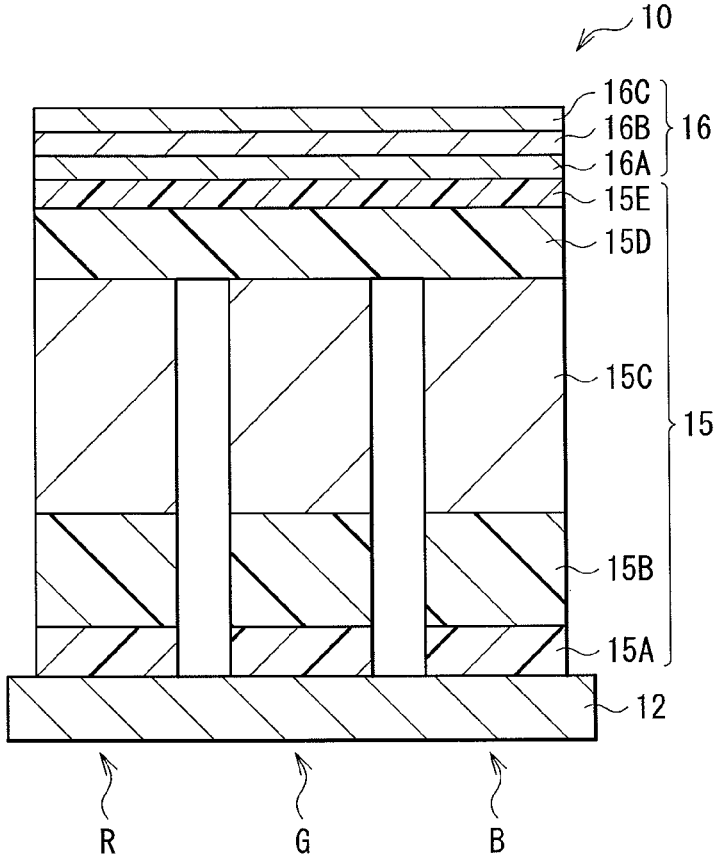
FIG. 6 is a cross-sectional diagram of an organic EL device of the display illustrated in FIG. 1.

The organic layer 15 has, for example, a configuration in which a hole injection layer 15A, a hole transport layer 15B, the light-emitting layer 15C, an electron transport layer 15D, and an electron injection layer 15E are laminated sequentially from a side closer to the anode electrode 12, as illustrated in FIG. 6. The organic layer 15 is formed by, for example, vacuum deposition, spin coating, or the like. A top face of this organic layer 15 is coated by the cathode electrode 16. A film thickness, a material, and the like of each layer of the organic layer 15 are not limited in particular, and an example will be described below.

The hole injection layer 15A is a buffer layer provided to enhance efficiency of hole injection to the light-emitting layer 15C, and also prevent leakage. The thickness of the hole injection layer 15A is, for example, preferably about 5 nm to about 200 nm both inclusive, and more preferably, about 8 nm to about 150 nm both inclusive. The material of the hole injection layer 15A may be selected as appropriate considering relations with the electrode and materials of adjacent layers. Examples of this material include polyaniline, polythiophene, polypyrrole, polyphenylene vinylene, polythienylene vinylene, polyquinoline, polyquinoxaline, derivatives of these materials, electroconductive polymers such as a polymer including an aromatic amine structure in a main chain or a side chain, metallophthalocyanine (copper phthalocyanine and the like), carbon, and the like. Specific examples of the electroconductive polymers include oligoaniline, and polydioxythiophene such as poly(3,4-ethylenedioxythiophene) (PEDOT).

The hole transport layer 15B is provided to increase efficiency of hole transport to the light-emitting layer 15C. The thickness of the hole transport layer 15B is, for example, preferably about 5 nm to about 200 nm both inclusive, and more preferably, about 8 nm to about 150 nm both inclusive, depending on the overall configuration of the device. As the material of the hole transport layer 15B, it is possible to use a luminescent material soluble in an organic solvent. Example of this luminescent material include polyvinylcarbazole, polyfluorene, polyaniline, polysilane, or derivatives of these materials, polysiloxane derivatives each having aromatic amine at a side chain or a main chain, polythiophene as well as derivatives thereof, polypyrrole, and $Alq_3$.

In the light-emitting layer 15C, electron-hole recombination takes place and light emission occurs, when an electric field is applied. The thickness of the light-emitting layer 15C is, for example, preferably about 10 nm to about 200 nm both inclusive, and more preferably, about 20 nm to about 150 nm both inclusive, depending on the overall configuration of the device. Each of the light-emitting layers 15C may be a single layer or in a layered structure. Specifically, for example, in addition to providing single light-emitting layers 15CR, 15CG, and 15CB of red, green, and blue, respectively, on the hole transport layer 15B as in the organic EL device 10 of the present embodiment, the blue light-emitting layer may be provided as a common layer of each of the organic EL devices 10R, 10G, and 10B. In this case, the blue light-emitting layer 15CB is laminated on the red light-emitting layer 15CR for the red organic EL device 10R, and on the green organic EL device 10G for the green light-emitting layer 15CG. In addition, although not illustrated here, the red light-emitting layer 15CR, the green light-emitting layer 15CG, and the blue light-emitting layer 15CB may be laminated. A white organic EL device is formed by laminating these layers.

As the material of the light-emitting layer 15C, a material corresponding to each color of light emission may be used. Examples of the material include a polyfluorene-based polymer derivative, a (poly)para-phenylene vinylene derivative, a polyphenylene derivative, a polyvinylcarbazole derivative, a polythiophene derivative, a perylene-based pigment, a coumarin-based pigment, a rhodamine-based pigment, and the above-mentioned polymers doped with an organic EL material. As a doped material, it is possible to use, for example, rubrene, perylene, 9,10-diphenylanthracene, tetraphenylbutadiene, nile red, coumarin 6, or the like. It is to be noted that as the material of the light-emitting layer 15C, a mixture of two or more kinds of the above-mentioned materials may be used. In addition, not only the high-molecular-weight materials mentioned above, but low-molecular-weight materials may be combined and used. Examples of the low-molecular-weight materials include benzine, styrylamine, triphenyl amine, porphyrin, triphenylene, azatriphenylene, tetracyanoquinodimethane, triazole, imidazole, oxadiazole, polyarylalkane, phenylenediamine, arylamine, oxazole, anthracene, fluorenone, hydrazone, stilbene, as well as derivatives of these materials, a monomer or oligomer of a conjugated heterocyclic system such as a polysilane-based compound, a vinylcarbazole-based compound, a thiophene-based compound, and an aniline-based compound.

As for the material of the light-emitting layer 15C, a material with high luminous efficiency may be used as a luminous guest material, in addition to the materials mentioned above. Examples of this material with high luminous efficiency include organic luminescent materials such as a low-molecular luminescence material, a phosphorescent dye, and a metal complex.

It is to be noted that the light-emitting layer 15C may be, for example, a hole transporting light-emitting layer serving as the hole transport layer 15B, or an electron transporting light-emitting layer serving as the electron transport layer 15D which will be described later.

The electron transport layer 15D and the electron injection layer 15E are provided to enhance efficiency of electron transport to the light-emitting layer 15C. The total film thickness of the electron transport layer 15D and the electron injection layer 15E is, for example, preferably, about 5 nm to about 200 nm both inclusive, and more preferably, about 10 nm to about 180 nm both inclusive, depending on the overall configuration of the device.

As the material of the electron transport layer 15D, it is desirable to use an organic material having a satisfactory electron transport ability. Variation in color of light emission due to a field intensity which will be described later is controlled by increasing transport efficiency of the light-emitting layer 15C. Specifically, it is preferable to use, for example, an arylpyridine derivative, a benzimidazole derivative, or the like, because this makes it possible to maintain high efficiency of electronic supply, even with a low drive voltage. Examples of the material of the electron injection layer 15E include alkali metal, alkaline earth metal, and rare earth metal as well as oxides, complex oxides, fluorides, and carbonates thereof.

The cathode electrode 16 has, for example, a thickness of about 10 nm, and, is configured using a material with satisfactory optical transparency and a small work function. Further, it is possible to ensure extraction of light, also by forming a transparent conductive film using an oxide. In this case, it is possible to use ZnO, ITO, IZnO, InSnZnO, or the like. Furthermore, the cathode electrode 16 may be a single layer, but here, for example, has a structure in which a first layer 16A, a second layer 16B, and a third layer 16C are sequentially laminated from a side closer to the anode electrode 12.

It is desirable that the first layer 16A be formed of a material with satisfactory optical transparency and a small work function. Specific examples of this material include alkaline earth metal such as calcium (Ca) and barium (Ba), alkali metal such as lithium (Li) and cesium (Cs), indium (In), magnesium (Mg), silver (Ag), and the like. The specific examples further include alkali metal oxides, alkali metal fluorides, alkaline-earth metal oxides, and alkaline-earth fluorides, such as $Li_2O$, $Cs_2Co_3$, $Cs_2SO_4$, MgF, LiF, and $CaF_2$.

The second layer 16B is configured using a material with optical transparency and satisfactory conductivity, such as a thin-film MgAg electrode or a Ca electrode. It is preferable that a transparent lanthanoide oxide be used for the third layer 16C, thereby suppressing deterioration of the electrode. This allows use as a sealing electrode capable of extracting light from the top face. Further, in the case of the bottom emission type, gold (Au), platinum (Pt), AuGe, or the like is used as the material of the third layer 16C.

It is to be noted that the first layer 16A, the second layer 16B, and the third layer 16C are formed by a technique such as vacuum deposition, sputtering, or plasma CVD (Chemical Vapor Deposition). Further, in a case where a drive system of a display using this display device is an active matrix system, the cathode electrode 16 may be formed like a solid film on the substrate 11, in an insulated state with respect to the anode electrode 12 by the liquid-repellant layer 14 (partition wall) covering a part of the anode electrode 12 and the organic layer 15. Thereby, the cathode electrode 16 may be used as a common electrode for each pixel.

In addition, the cathode electrode 16 may be a mixed layer containing an organic luminescent material such as a quinoline aluminum complex, a styrylamine derivative, a phthalocyanine, or like. In this case, a layer (not illustrated) having optical transparency like one made of MgAg or the like may be additionally provided as the third layer 16C. Further, it goes without saying that the cathode electrode 16 is not limited to a layered structure as described above, and may have an optimal combination and layered structure, according to a configuration of a produced device. For instance, the cathode electrode 16 of the present embodiment has a layered structure with a function of separating each layer of the electrode. In this layered structure, an inorganic layer (the first layer 16A) accelerating electron injection into the organic layer 15, an inorganic layer (the second layer 16B) controlling the electrode, and an inorganic layer (the third layer 16C) protecting the electrode are separated. However, the inorganic layer accelerating the electron injection into the organic layer 15 may serve as the inorganic layer controlling the electrode, and these layers may be in a single-layer structure.

Furthermore, it is preferable to configure the cathode electrode 16 by using a semi-transmissive and semi-reflective material, when this organic EL device 10 has a cavity structure. Thus, emitted light is extracted from the cathode electrode 16, after being subjected to multiple interaction between a light reflecting surface located closer to the anode electrode 12 and a light reflecting surface located closer to the cathode electrode 16. In this case, an optical distance between the light reflecting surface located closer to the anode electrode 12 and the light reflecting surface located closer to the cathode electrode 16 is assumed to be defined by a wavelength of light desired to be extracted, and the film thickness of each layer is assumed to be set to meet this optical distance. In such a display device of the top-emission type, it is possible to improve efficiency of light extraction toward outside and control an emission spectrum, by actively using this cavity structure.

A protective layer 17 is provided to prevent entrance of water into the organic layer 15, and formed using a material with transparency and low permeability, to have a thickness of about 2 μm to about 3 μm both inclusive, for example. The protective layer 17 may be configured using either an insulating material or a conductive material. As the insulating material, an inorganic amorphous insulating material is desirable. Examples of the inorganic amorphous insulating material include amorphous silicon (α-Si), amorphous silicon carbide (α-SiC), amorphous silicon nitride (α-$Si_{1-x}N_x$), and amorphous carbon (α-C). Such an inorganic amorphous insulating material does not form grains and thus has low permeability, thereby forming a satisfactory protective film.

A sealing substrate 18 is located closer to the cathode electrode 16 in the organic EL device 10, and seals the organic EL device 10, in cooperation with an adhesion layer (not illustrated). The sealing substrate 18 is configured using a material such as glass, which is transparent with respect to the light produced in the organic EL device 10. The sealing substrate 18 is provided with, for example, a color filter and a light-shielding film serving as a black matrix (neither is illustrated). The sealing substrate 18 extracts the light produced in the organic EL device 10, and also absorbs external light reflected in wiring between the organic EL devices, thereby improving contrast.

For example, the color filter and the light-shielding film (neither is illustrated) may be provided on the sealing substrate 18. The color filter includes a red filter, a green filter, and a blue filter (none is illustrated), which are disposed sequentially. The red filter, the green filter, and the blue filter are each shaped like a rectangle, for example, and formed seamlessly. The red filter, the green filter, and the blue filter are each made of a resin mixed with a pigment, and are adjusted to allow a high light transmittance in a wavelength region of targeted red, green, or blue and a low light transmittance in other wavelength regions.

The light-shielding film is configured using, for example, a black resin film or a thin-film filter. The black resin film is mixed with a black coloring agent and having an optical density of not less than 1, and the thin-film filter uses thin-film interference. Of these, the black resin film is desirable, because when the light-shielding film is configured using the black resin film, it is possible to form the light-shielding film easily at a low cost. The thin-film filter is, for example, a filter in which one or more thin films made of metal, a metal nitride, or a metal oxide are laminated, and light is attenuated using the thin-film interference. As a specific example of the thin-film filter, there is a filter in which Cr and chromium oxide (III) ($Cr_2O_3$) are laminated alternately.

Incidentally, it is also possible to form the organic layer 15 by a method such as a coating method or a printing method, other than vacuum deposition and spin coating. Examples of the coating method include a dipping method, a doctor blade method, a discharge coating method, and a spray coating method. Examples of the printing method include an ink-jet method, offset printing, a letterpress printing method, an intaglio printing method, screen printing, and a microgravure coating method. Also, a dry process and a wet process may be used together, depending on a property of each of organic layers and each of members.

In this display 1A, each pixel is supplied with the scanning signal from the scanning-line driving circuit 130 via the gate electrode of the write transistor Tr2, and also, the image signal output from the signal-line driving circuit 120 is retained at the capacitor Cs via the write transistor Tr2. In other words, the drive transistor Tr1 is controlled to be ON/OFF according to this signal retained at the capacitor Cs, and thereby a driving current Id is fed to the organic EL device 10, which causes electron-hole recombination resulting in emission of light. This light is extracted after passing through the anode electrode 12 and the substrate 11 in the case of the bottom emission, or after passing through the cathode electrode 16, the color filter (not illustrated), and the sealing substrate 18 in the case of the top emission.

In the display 1A of the present embodiment, the first liquid-repellent regions 2B and the first lyophilic regions 2A are provided in the display region 2. The first liquid-repellent regions 2B divide the plurality of pixels 5R, 5G, and 5B for each color, and are provided around the plurality of pixels arranged in the matrix. The first lyophilic regions 2A are provided in the region excluding the first liquid-repellent regions 2B. Therefore, it is possible to obtain a desired pixel pattern. In addition, the second lyophilic region 3A is provided outside of the first liquid-repellent region 2B, namely, in the peripheral region 3. Thus, a sufficient bead is formed at the time of applying the ink onto the first lyophilic regions 2A, and stable application of the ink to the first lyophilic region 2A is allowed.

In this way, in the display 1A (and an electronic unit) of the present embodiment, the first liquid-repellent regions 2B are provided to divide the color pixels 5R, 5G, and 5B for each color, and the first lyophilic regions 2A are provided in the region excluding the first liquid-repellent regions 2B, in the display region 2. Thus, the organic layer 15 is formed into a desired pixel pattern. In addition, because the second lyophilic region 3A is provided in the peripheral region 3, it is possible to form a sufficient liquid bank (bead) in the bead formation. The bead formation serves as a preparatory stage in forming the organic layer 15 by applying the ink to the first lyophilic regions 2A. This allows stable application of the ink to the first lyophilic region 2A. In other words, accurate patterning of the organic layer 15 is enabled in a simple way regardless of a density (viscosity) of the ink, which improves device characteristics. Thus, it is possible to provide the display 1A of full color, having stable characteristics, in a simple way.

2. Second Embodiment

Figure 7:
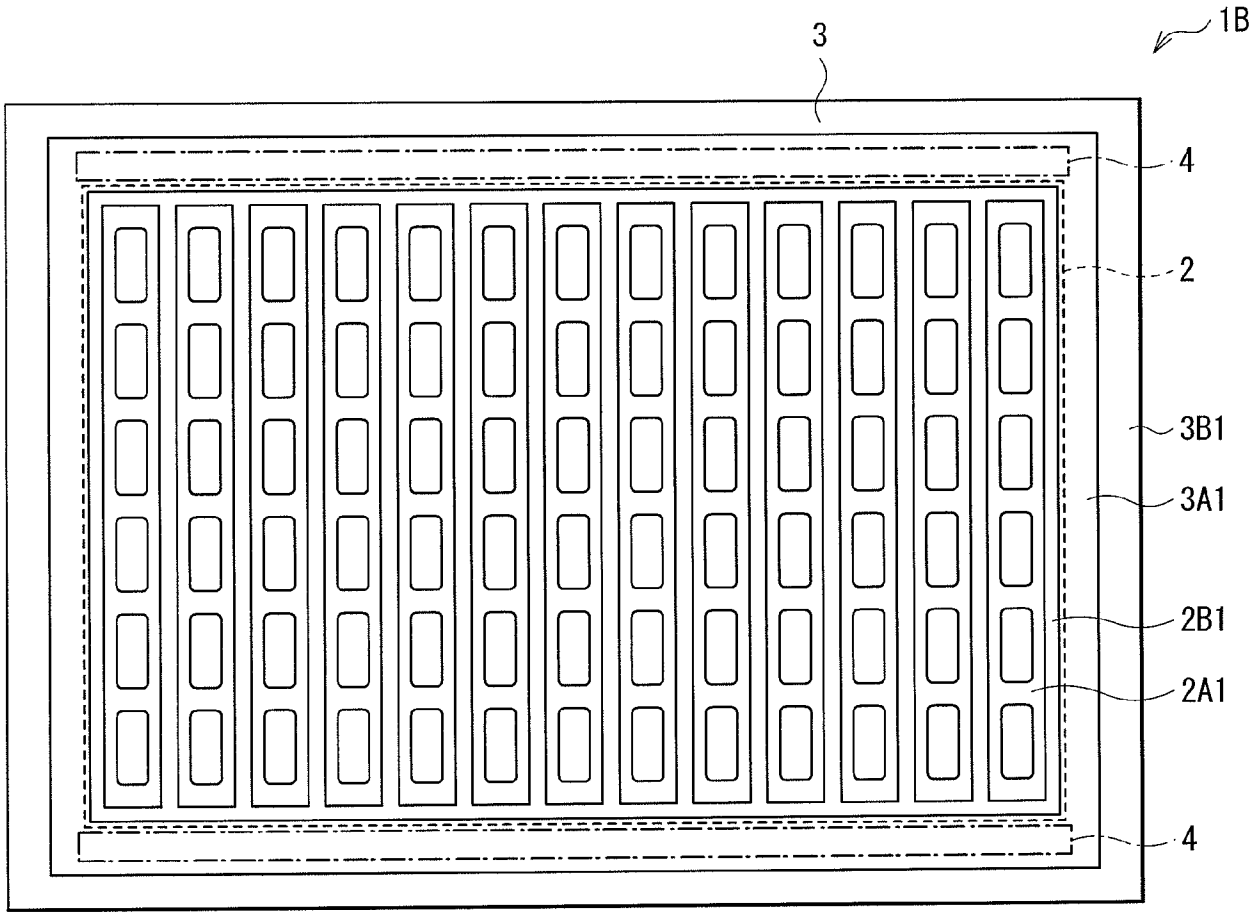
FIG. 7 is a plan view illustrating a configuration of a display according to a second embodiment of the disclosure.

FIG. 7 illustrates a plane configuration of a display region 2 and a peripheral region 3 of a display 1B in the second embodiment. In the display 1B of the present embodiment, first lyophilic regions $2A_1$ and first liquid-repellent regions $2B_1$ shaped like those of the display 1A in the first embodiment are formed in the display region 2. In the peripheral region 3, a second lyophilic region $3A_1$ and a second liquid-repellent region $3B_1$ are formed. The second lyophilic region $3A_1$ is formed to be identical in shape to a bead formation region 4, or to include the bead formation region 4. The second liquid-repellent region $3B_1$ is provided in a peripheral section of the peripheral region 3, thereby surrounding the second lyophilic region $3A_1$. Thus, the second embodiment is different from the first embodiment, in terms of the peripheral region 3.

In the display 1B of the present embodiment, the second liquid-repellent region $3B_1$ is provided outside the second lyophilic region $3A_1$ provided in the peripheral region 3. This makes it possible to prevent an excessive wet spread of ink, and improve material utilization efficiency, in a bead formation process. In addition, contact between wiring (not illustrated), which is formed in the peripheral region 3, namely, in the peripheral section in particular, and an organic layer 15 is prevented. Therefore, occurrence of a short circuit is suppressed.

It is to be noted that here, the second liquid-repellent region $3B_1$ is provided over the entire peripheral section of the peripheral region 3, but is not limited to this. Alternatively, the second liquid-repellent region $3B_1$ may be formed as a region equal to or greater than a width in a longitudinal direction of the bead formation region, in at least outside of the bead formation region 4. Further, it is more preferable that the second lyophilic region $3A_1$ be identical in shape to the bead formation region 4, and other region of the peripheral region 3 be the second liquid-repellent region $3B_1$. This makes it possible to further ensure the bead formation, thereby improving reliability. Moreover, the peripheral region 3 excluding the bead formation region 4 is covered by a liquid-repellant layer. Therefore, it is possible to prevent a short circuit in the wiring due to a foreign matter and the like, allowing an improvement in reliability.

Figure 8:
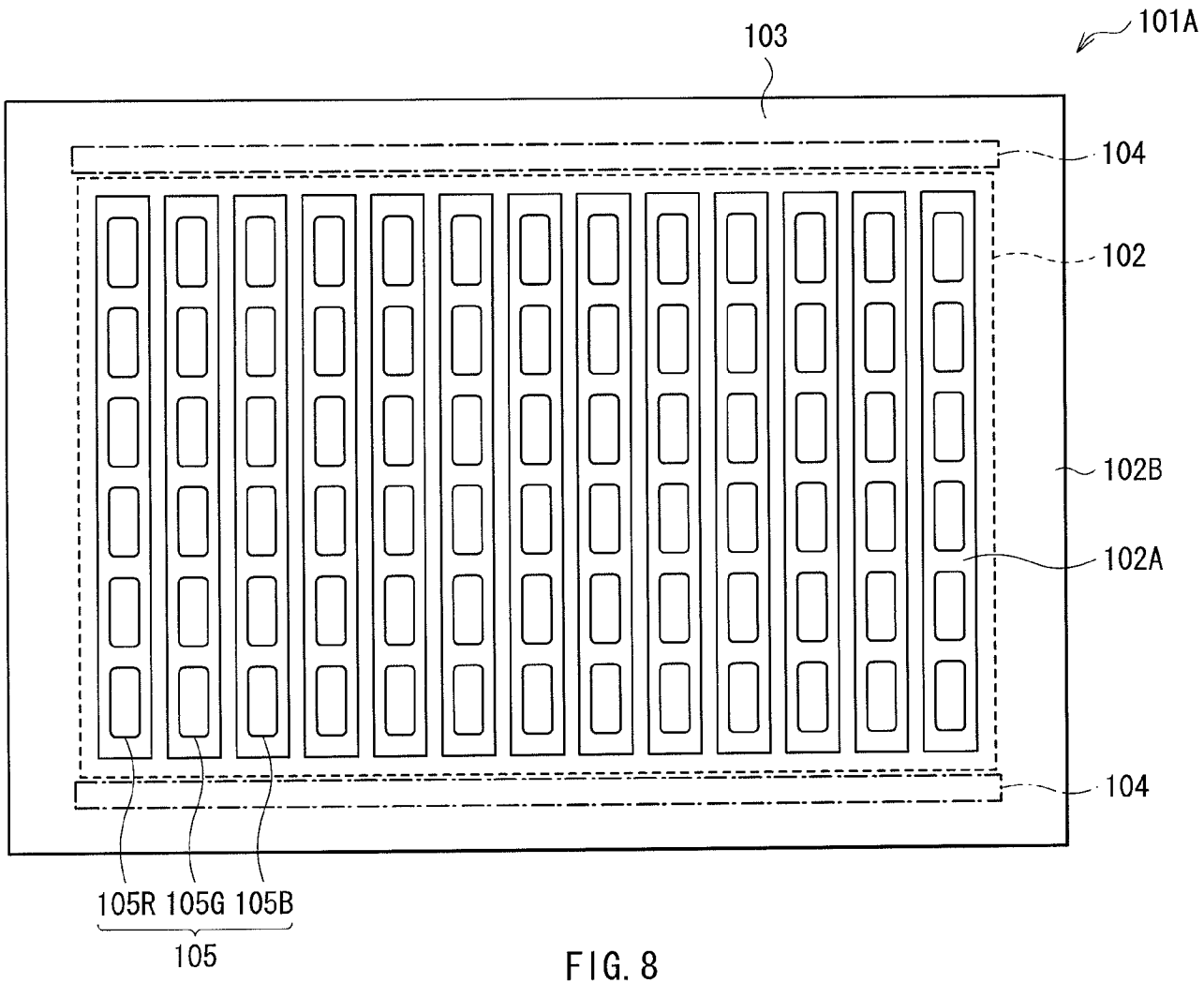
FIG. 8 RELATED ART
FIG. 8 is a plan view illustrating a configuration of a display according to a comparative example.

Here, there will be described an experimental result in terms of bead formation, bead width, and RGB coloring, in the display 1A in the first embodiment, the display 1B in the present embodiment, and a display 101A in a comparative example. In the comparative example, a liquid-repellent region 102B is formed over a whole of a peripheral region 103, as illustrated in FIG. 8.

Table 1 provides acceptability of the bead formation, the bead width, and the RGB coloring, in the display 1A, the display 1B, and the display 101A.

TABLE 1

| | Liquid-repellent treatment in first liquid-repellent regions | Bead formation | Bead width | RGB coloring |
|---|---|---|---|---|
| Display 1A | $CF_4$ plasma | Fair | 4 mm | Fair |
| | — | Fair | 4 mm | Failure |
| Display 1B | $CF_4$ plasma | Excellent | 2 mm | Fair |
| | — | Fair | 3.5 mm | Failure |
| Display 101A | $CF_4$ plasma | Failure | Failure | Failure |
| | — | Fair | 5 mm | Failure |

As apparent from Table 1, wet spread of the bead is suppressed by providing the second liquid-repellent region $3B_1$ around the second lyophilic region $3A_1$ in the peripheral region 3, as compared with the display 1A in which the second liquid-repellent region $3B_1$ is not formed in the peripheral region 3. In contrast, it has been found that the bead is not formed in the display 101 in which the liquid-repellent region 103B is formed on the entire surface of the peripheral region 103. Even when the bead is formed in the display 101, wet spread is wider than those of the beads in other displays. In addition, it has been found that the RGB coloring is enabled, through addition of liquid repellency by subjecting the first liquid-repellent regions to a liquid-repellent treatment with $CF_4$ plasma or the like.

In the display 1B (and an electronic unit) of the present embodiment, the second liquid-repellent region $3B_1$ is provided around the second lyophilic region $3A_1$ in the peripheral region 3. Thus, the wet spread of the bead is suppressed, and the material utilization efficiency is improved. In addition, since the contact between the wiring and the organic layer 15 is suppressed, occurrence of a short circuit is prevented. In other words, in addition to effects of the first embodiment, an effect of reducing cost and also improving reliability is produced.

The third to eighth embodiments will be described below. It is to be noted that the same elements as those of the first embodiment will be provided with the same characters as those of the first embodiment, in a manner similar to the second embodiment, and the description will be omitted.

3. Third Embodiment

Figure 9A:
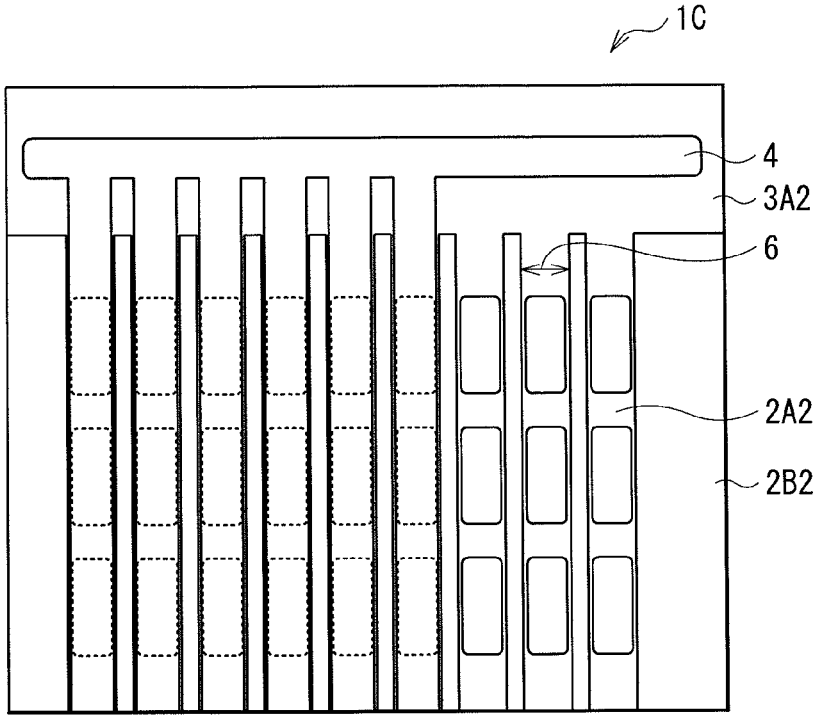
FIGS. 9A and 9B are plan views each illustrating a configuration of a part of a display according to a third embodiment of the disclosure.

FIG. 9A illustrates a plane configuration of a display region 2 and a peripheral region 3 of a display 1C in the third embodiment. In the display 1C of the present embodiment, first lyophilic regions $2A_2$ are formed in the display region 2, a second lyophilic region $3A_2$ is provided in the peripheral region 3, and the first lyophilic regions $2A_2$ and the second lyophilic region $3A_2$ are continuous with each other. This is a point different from the first and second embodiments.

A head and a substrate 11 are sufficiently connected via ink by forming a bead in a bead formation region 4 of the peripheral region 3, before application of the ink to pixel lines, namely, the first lyophilic region $2A_2$. Therefore, stable application of the ink to the first lyophilic region $2A_2$ is possible. However, in a case where the bead formation region 4 and the pixel lines, namely, the second lyophilic region $3A_2$ and the first lyophilic region $2A_2$, are divided by first liquid-repellent regions $2B_2$ like the first and second embodiments, a change in application quantity or running out of the ink might occur, when the ink straddles the first liquid-repellent regions $2B_2$ at the time of continuous application from the bead formation region 4 to the pixel lines.

In contrast, in the display 1C of the present embodiment, a wide section 6 is provided at one end of the first liquid-repellent regions $2B_2$ formed in the display region 2. Specifically, the wide section 6 is orthogonal to a longitudinal direction of the first liquid-repellent regions $2B_2$, and formed at an end face closer to the bead formation region 4. Thus, the first lyophilic region $2A_2$ and the second lyophilic region $3A_2$ provided in the peripheral region 3 are made to be continuous with each other. Thus, it is possible to prevent a change in application quantity or running out of the ink due to the ink straddling the first liquid-repellent regions $2B_2$, at the time of application of the ink from the bead formation region 4 within the second lyophilic region $3A_2$ to the first lyophilic region $2A_2$. This makes it possible to apply the ink to the first lyophilic region $2A_2$ stably. In other words, there is produced an effect of improving manufacturing yield, in addition to the effects of the first and second embodiments.

Figure 9B:
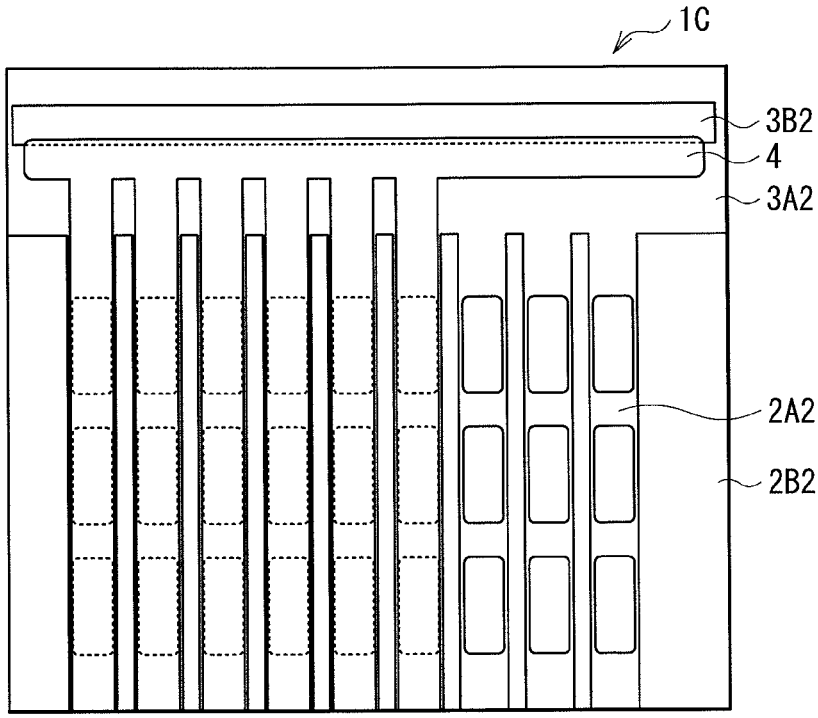

It is to be noted that in the display 1C of the present embodiment, as illustrated in FIG. 9B, a second liquid-repellent region $3B_2$ may be provided outside the second lyophilic region $3A_2$ (in particular, the bead formation region 4) in the peripheral region 3 in a manner similar to the second embodiment. This makes it possible to form the bead reliably, thereby improving reliability of the display. This also applies to the fourth to seventh embodiments which will be described below.

4. Fourth Embodiment

Figure 10:
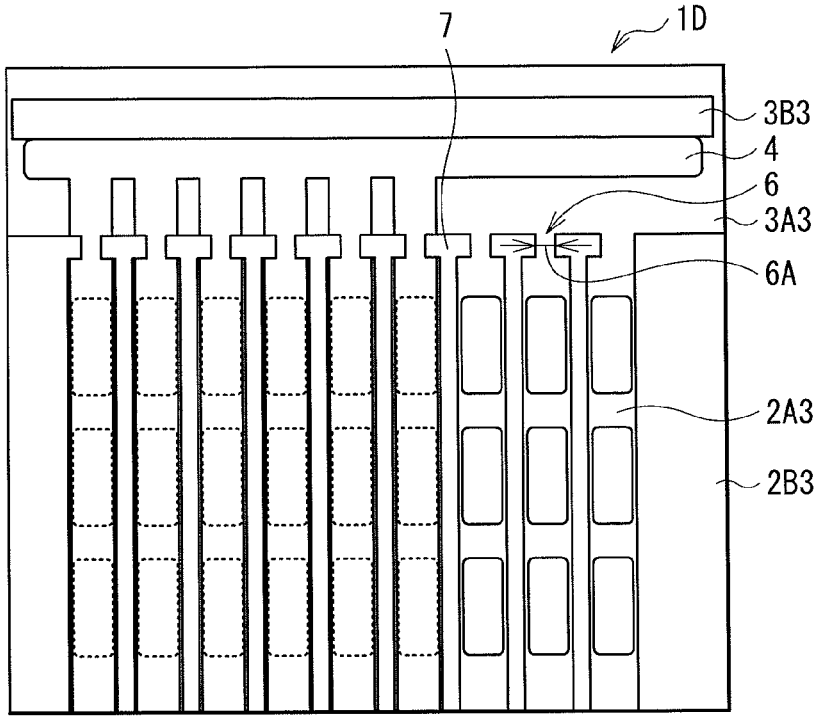
FIG. 10 is a plan view illustrating a configuration of a part of a display according to a fourth embodiment of the disclosure.

FIG. 10 illustrates a plane configuration of a display region 2 and a peripheral region 3 of a display 1D according to the fourth embodiment. In this display 1D, first lyophilic regions $2A_3$ and a second lyophilic region $3A_3$ are continuous with each other, like the third embodiment. In the present embodiment, wide sections 6 where the first lyophilic regions $2A_3$ and the second lyophilic region $3A_3$ are continuous with each other are formed at one end of first liquid-repellent regions $2B_3$. Further, wing pieces 7 are provided at one end of the first liquid-repellent regions $2B_3$, thereby narrowing a width of each wide section 6 between the adjacent first liquid-repellent regions $2B_3$. As a result, there are formed narrow regions 6A of the wide sections 6, which is a point different from the third embodiment.

In the third embodiment, occurrence of events such as running out of the ink at the time of the application is reduced, by making the first lyophilic regions $2A_2$ and the second lyophilic region $3A_2$ continuous with each other. However, there is a possibility that the ink might flow out from the first lyophilic regions $2A_z$ into the second lyophilic region $3A_2$, depending on the viscosity and surface tension of the ink. This leads to a disadvantage that it is difficult to adjust the film thickness of the organic layer 15, and a distribution of the film thickness in the pixel line occurs.

In contrast, in the display 1D of the present embodiment, the wing pieces 7 are provided at the one end of the first liquid-repellent regions $2B_3$, the one end where the wide sections 6 are provided to make the first lyophilic regions $2A_3$ and the second lyophilic region $3A_3$ continuous with each other. Therefore, the narrow regions 6A are formed. Thus, the wide sections 6 provided at the one end of the first lyophilic regions $2A_3$ are narrowed, and an outflow of the ink applied to the first lyophilic regions $2A_3$ is suppressed. In other words, in addition to the effects of the third embodiment, there is produced an effect of maintaining uniformity of the film thickness in the surface of the organic layer 15 formed by the application, and reducing variations in device characteristic.

5. Fifth Embodiment

Figure 11:
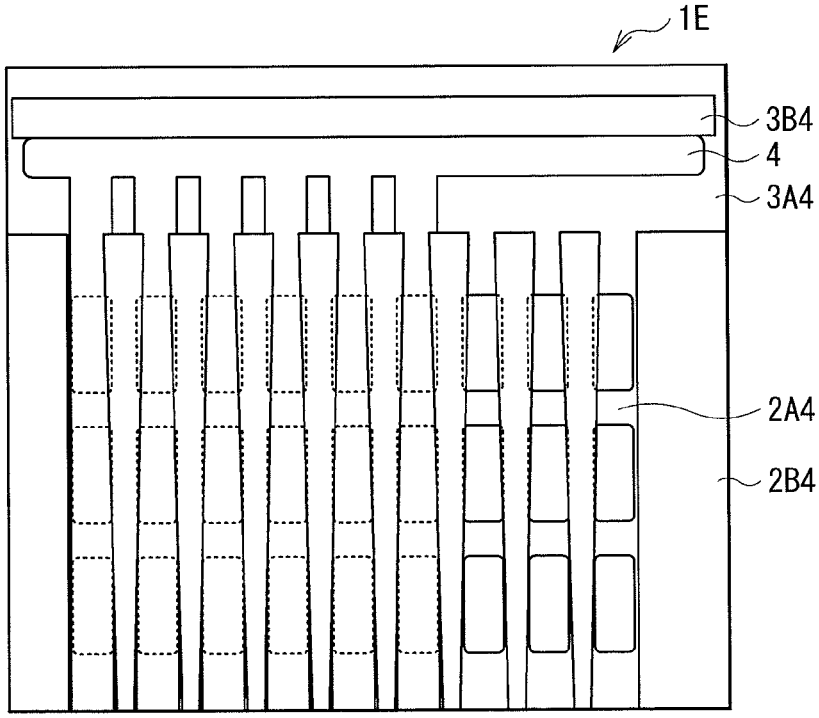
FIG. 11 is a plan view illustrating a configuration of a part of a display according to a fifth embodiment of the disclosure.

FIG. 11 illustrates a plane configuration of a display region 2 and a peripheral region 3 of a display 1E according to the fifth embodiment. In this display 1E, a width of each of first lyophilic regions $2A_4$ formed in the display region 2 changes along a longitudinal direction. Specifically, here, a width of each of first liquid-repellent regions $2B_4$ is formed to become gradually narrow, from a starting-point side to an endpoint side of application.

When formation by application is performed through discharge of ink from a head as in the present embodiment, there is a possibility that the ink might extend to the head side during a coating process, depending on a balance between a shape and surface texture of a head, as well as a viscosity and surface tension of the ink. When the ink extends to the head side, there is a possibility that an application shape might enlarge with a scan, and distribution in application quantity might occur as the scan progresses. When the distribution in the application quantity occurs, it is difficult of control the film thickness, and distribution of the film thickness on the pixel lines takes place. As a result, variations in device characteristic occur.

In the display 1E of the present embodiment in contrast, the width of each of the first lyophilic regions $2A_4$ is made to widen gradually along the longitudinal direction. This suppresses the distribution of the film thickness caused by a change in the application quantity of the ink. Hence, the occurrence of the variations in device characteristic is suppressed.

It is to be noted that, in the present embodiment, the width of each of the first lyophilic regions $2A_4$ is made to widen gradually along the longitudinal direction. However, without being limited to this, the width of each of the first lyophilic regions $2A_4$ may be changed as appropriate, depending on a change in the application quantity of the ink discharged from the head. For example, when the application quantity gradually decreases immediately after the application begins, each of the first lyophilic regions $2A_4$ is made to become gradually narrow along the longitudinal direction, in a way opposite to the change in the width of each of the first lyophilic regions $2A_4$ in the present embodiment. This suppresses occurrence of the distribution of the film thickness.

6. Sixth Embodiment

Figure 12:
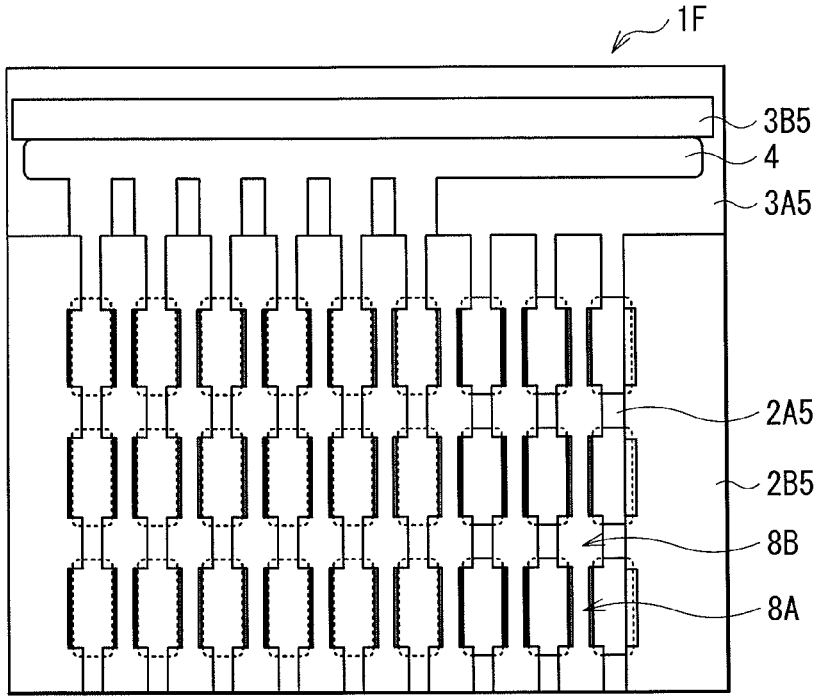
FIG. 12 is a plan view illustrating a configuration of a part of a display according to a sixth embodiment of the disclosure.

FIG. 12 illustrates a plane configuration of a display region 2 and a peripheral region 3 of a display 1F according to the sixth embodiment. In this display 1F, each of first liquid-repellent regions $2B_5$ is patterned into a shape following openings of pixels. Specifically, each of the first liquid-repellent regions $2B_5$ is patterned to be depressed at parts adjacent to the pixels 5 and protrude at parts not adjacent to the pixels 5, so that the first liquid-repellent regions $2B_5$ surround the openings of the pixels intermittently. This is a point different from the first to fifth embodiments.

When the ink is applied to the region partitioned by the liquid-repellant layer 14, and a desired layer (here, the organic layer 15) is formed by removing the solvent as illustrated in FIG. 5, there is a possibility that a liquid surface of the ink might extend along a sidewall of the liquid-repellant layer 14, causing a U-shaped or W-shaped distribution of the film thickness. A thick film part in this U-shaped or W-shaped distribution of the film thickness does not emit light, reducing a light-emission area.

In the display 1F of the present embodiment in contrast, the width of each of the first liquid-repellent region $2B_5$ is formed so that depression sections 8A are provided at the parts adjacent to the pixels 5 and projection sections 8B are provided at the parts not adjacent to the pixels 5, to correspond to pixel opening sections defined by first lyophilic regions $2A_5$.

Therefore, the film thickness in each of a long-side direction and a short-side direction of the pixel opening sections is formed uniformly, making it possible to reduce a decrease in the light-emission area. It is to be noted that the shape of each of the projection sections 8B protruding in the short-side direction of the pixel 5 is not limited to a rectangular shape as illustrated in FIG. 12. Entrance of the ink may be improved by rounding right-angle parts.

7. Seventh Embodiment

Figure 13:
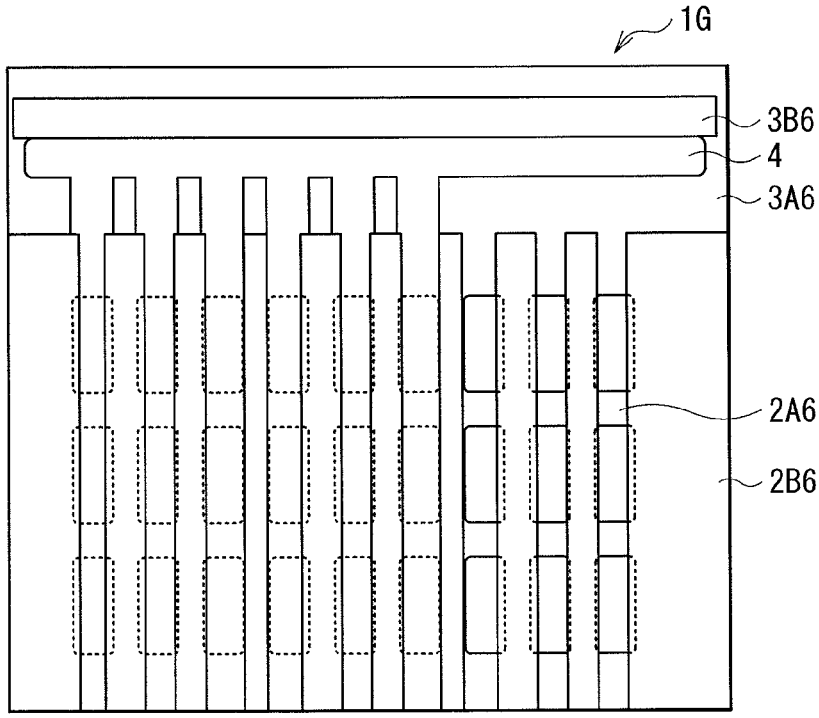
FIG. 13 is a plan view illustrating a configuration of a part of a display according to a seventh embodiment of the disclosure.

FIG. 13 illustrates a partial plane configuration of a display region 2 and a peripheral region 3 in a display 1G according to the seventh embodiment. In this display 1G, a width of each of first lyophilic regions $2A_6$ and a width of each of first liquid-repellent regions $2B_6$ are adjusted for each of pixels 5R, 5G, and 5B of the respective colors forming display pixels, which is a point is different from other embodiments.

As a combination of organic EL devices of a display, there is RGBY (yellow), RGBW (white), a single color (e.g., W), YYB, or the like, other than three colors of RGB. It is desirable that the hole injection layer 15A, the hole transport layer 15B, and the like of the organic EL device of each color be formed to have the respective film thicknesses varying from device to device, so as to meet an optimum optical interference condition for each color. In order to adjust the film thickness for each device in the first lyophilic regions and the first liquid-repellent regions of the same widths without distinguishing the pixels 5R, 5G, and 5B lines of the respective colors, as in the first to sixth embodiments, there is a method of changing the density of the ink for each pixel line. In this method, an additional facility of adjusting the density of the ink for every pixel line is necessary, and work of changing the ink density in a process is desired. Therefore, there is a disadvantage that producibility is greatly reduced and cost is increased.

In the display 1G of the present embodiment, the widths of the first lyophilic regions $2A_6$ and the first liquid-repellent regions $2B_6$ are adjusted as appropriate for every pixel line of each color. Therefore, it is possible to form the layers having the film thicknesses corresponding to each color, even when the application is performed with the inks of the same densities on the same conditions. In other words, producibility is improved, and cost is reduced. In addition, in the common layers (e.g., the hole injection layer 15A and the hole transport layer 15B) for each color, it is possible to achieve desired thicknesses, even when the layers are collectively formed using a surface-coating configuration such as a slit coating method. Therefore, it is possible to further improve the producibility and reduce of the cost.

8. Eighth Embodiment

Figure 14:
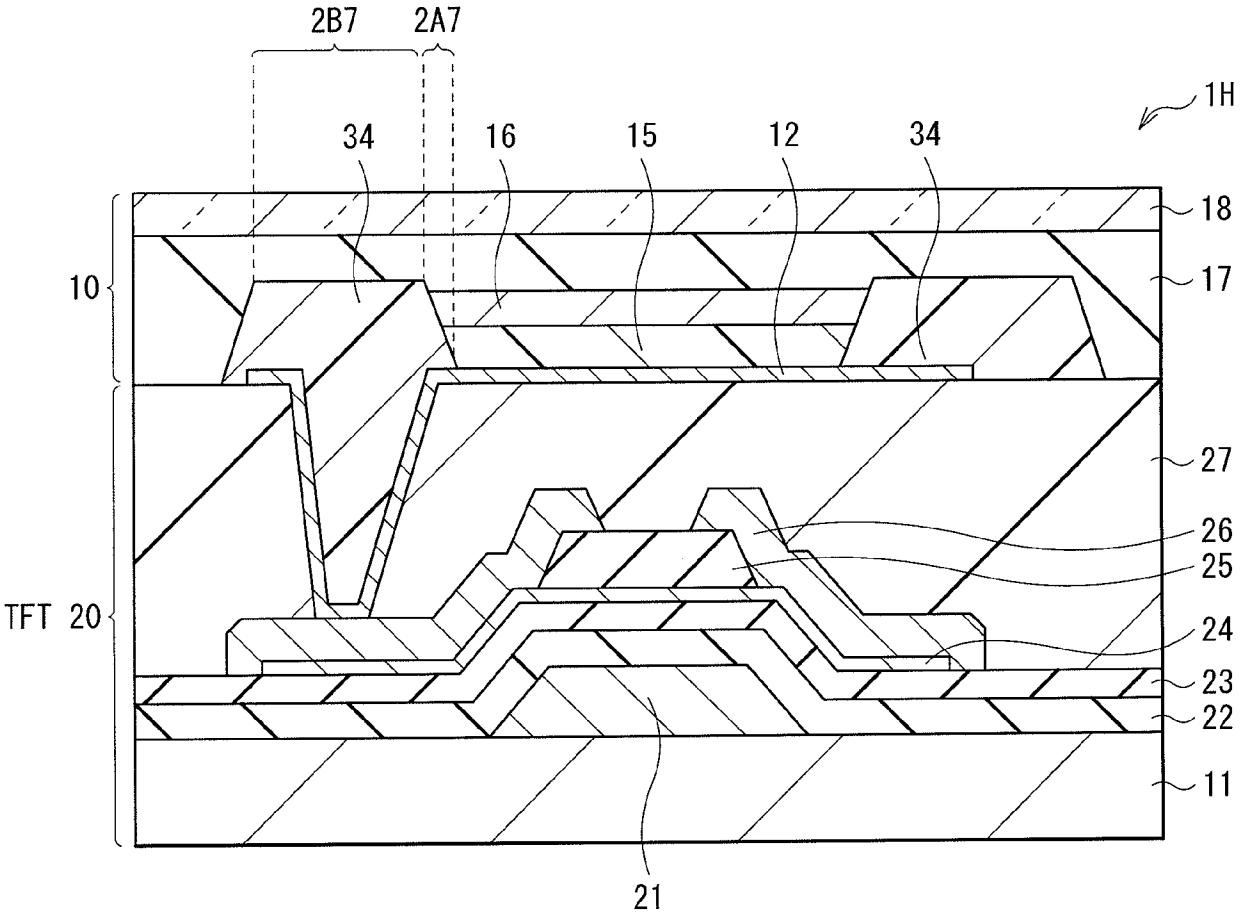
FIG. 14 is a cross-sectional diagram illustrating an example of a display according to an eighth embodiment of the disclosure.

FIG. 14 illustrates a cross-sectional configuration of a display 1H according to the eighth embodiment. In this display 1H, first liquid-repellent regions $2B_7$ dividing pixels 5 (red pixels 5R, green pixels 5G, and blue pixels 5B) disposed in lines and first lyophilic regions $2A_7$ provided to improve wettability of ink are formed of the same material, which is a point different from the above-described embodiments.

Figure 15A:
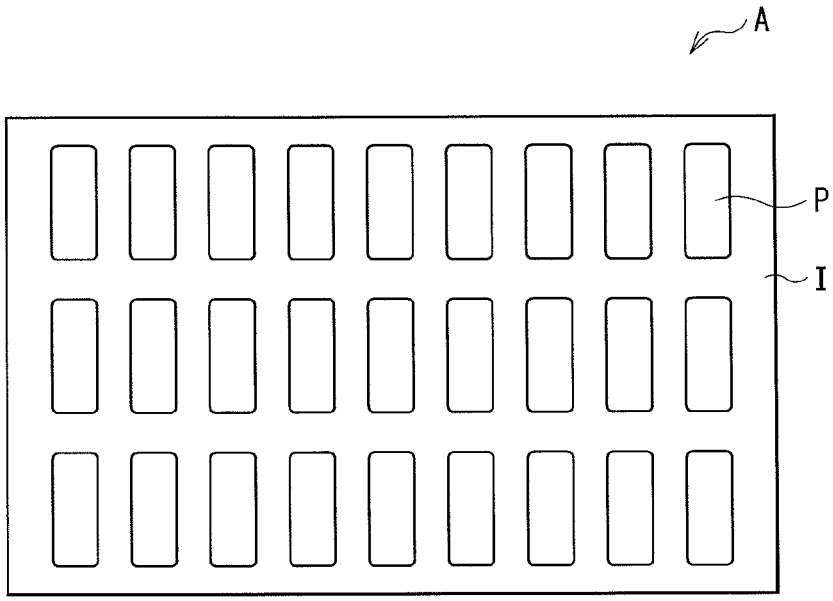
FIGS. 15A and 15B are schematic diagrams each illustrating a configuration of a photomask.

As a material of the first lyophilic regions $2A_7$ and the first liquid-repellent regions $2B_7$ in the present embodiment, there is a fluorine-containing material, a specific example of which is NPAR515 produced by Nissan Chemical Industries, Ltd. In a method of forming the first lyophilic regions $2A_7$ and the first liquid-repellent regions $2B_7$ using the above-mentioned material, after an anode electrode 12 is formed on a flattening layer 27, a solid film made of the fluorine-containing material is formed on the entire surface of each of the flattening layer 27 and the anode electrode 12, by using a slit coating method, for example. Next, full exposure is performed using a photomask A that has a pattern with transparent regions P and non-transparent regions I. The transparent regions P correspond to the pixels 5 arranged in a matrix as illustrated in FIG. 15A. As a result, partition walls 34 that partition the pixels 5 are formed. In an applied film formed of the fluorine-containing material, fluorine groups exhibiting liquid repellency are aligned on a film surface. Therefore, the surface of the applied film exhibits liquid repellency, and inside of the applied film exhibits hydrophilicity. In other words, as for the walls 34 formed by the method described above, each of the first liquid-repellent regions $2B_7$ is formed on a top face of each of the walls 34, and each of the first lyophilic regions $2A_7$ is formed on a side face where the inside is exposed by exposure etching. In the present embodiment, the first lyophilic regions $2A_7$ and the first liquid-repellent regions $2B_7$ are thus formed in the same process. It is to be noted that as the material of the first lyophilic regions $2A_7$ and the first liquid-repellent regions $2B_7$, any material other than the fluorine-containing material described above may be used, as long as the material is capable of forming a film in which a surface has liquid repellency and inside has hydrophilicity. Moreover, in the formation process of the partition walls 34 described above, although the partition walls 34 are formed by one exposure after the solid film is formed, the shape of the partition walls 34 may be processed by adding an exposure process. The details will be described below.

Figure 15B:
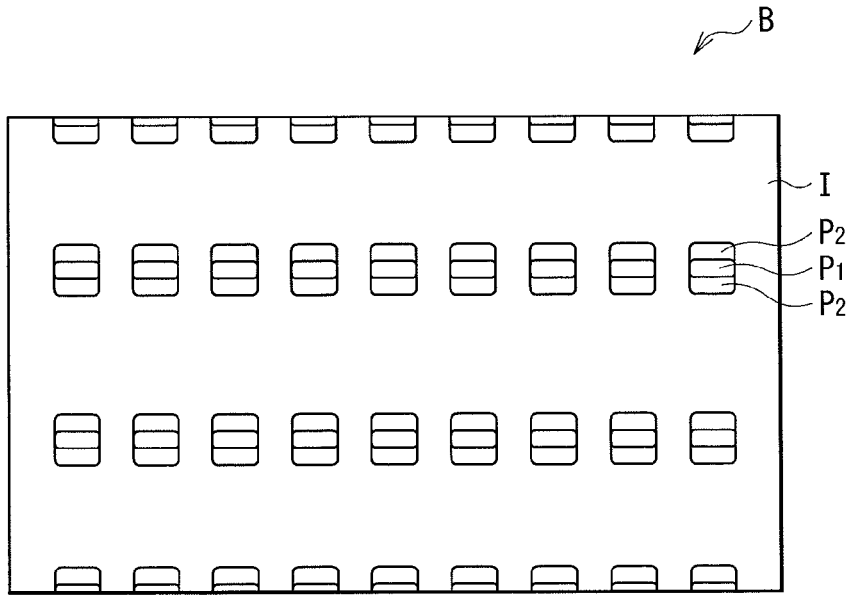
Figure 16A:
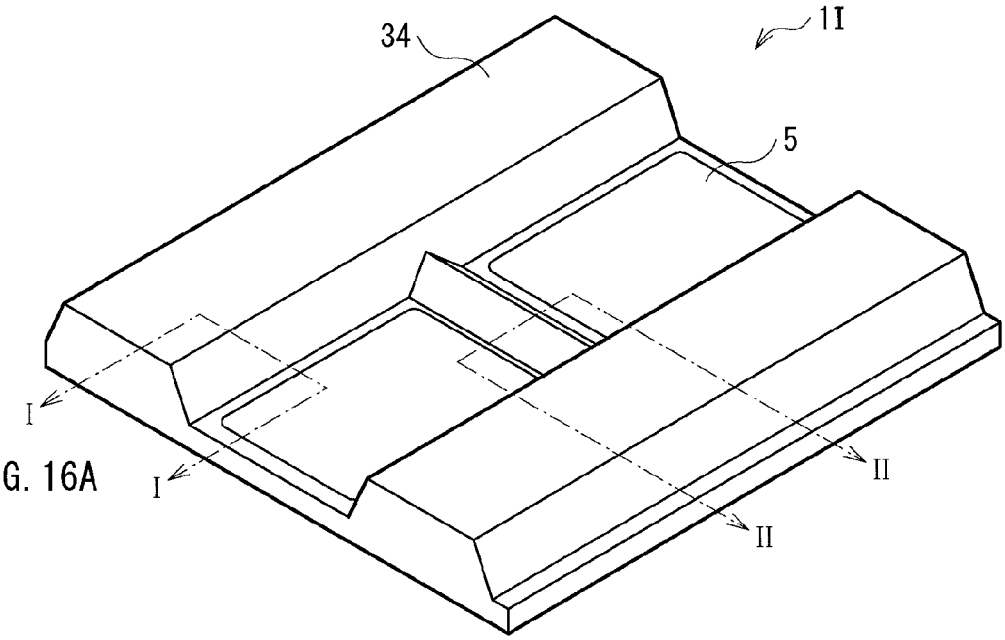
FIGS. 16A to 16C are diagrams each illustrating another example of the display according to the eighth embodiment of the disclosure, specifically.
Figure 16B:
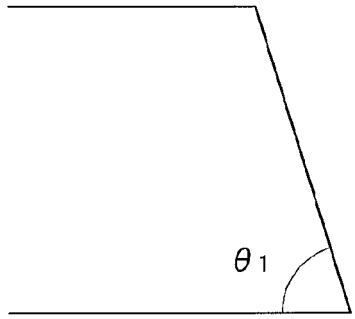
Figure 16C:
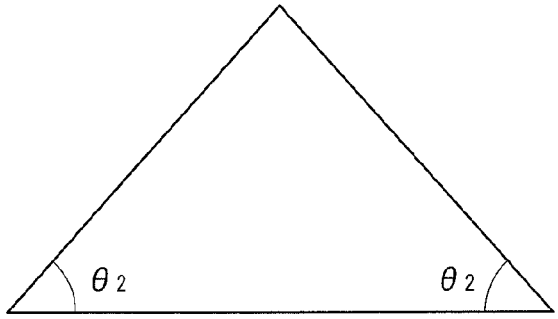

FIG. 16A is a perspective view of a part of a display region in a display 1I, FIG. 16B is a cross-sectional view of a partition wall 34 viewed in a long-side direction of pixels 5, and FIG. 16C is a cross-sectional view of a partition wall 34 viewed in a short-side direction of the pixels 5. In this display 1I, the partition wall 34 between the pixels next to each other in the short-side direction is processed after the above-mentioned full exposure. Specifically, after the full exposure is performed using the photomask A having the pattern corresponding to the respective pixels 5 illustrated in FIG. 15A, half exposure using a photomask B having a pattern as illustrated in FIG. 15B, for example, is performed at each position between the pixels next to each other in the short-side direction. It is to be noted that transmission sections P1 and P2 have a transmittance of about a few percent, and the transmittance of the transmission sections P1 is lower than that of the transparent regions P2. By adding the exposure using the photomask B, the first liquid-repellent regions 2B formed on the top face is removed, and there is formed the partition wall 34 having a taper angle (θ2, FIG. 16C) smaller than a taper angle (θ1, FIG. 16B) of the partition wall 34 formed in the long-side direction of the pixels 5.

When a liquid-repellent region is formed on the top face of each of the partition walls 34 adjacent to the pixels 5 in the short-side direction as in the display 1H described above, a part of the ink applied in a line is accumulated on the liquid-repellent regions $2B_7$, and thereafter flows randomly into front and back of each of the pixels. For this reason, the organic layer 15 might vary by the pixel 5 in terms of application quantity, namely, film thickness. In contrast, in the display 1I illustrated in FIG. 16A, the first liquid-repellent regions $2B_7$ between the pixels next to each other in the short-side direction are removed by the half exposure, and inside of a solid film having hydrophilicity is exposed. Therefore, it is possible to reduce variations in the film thickness among the pixels 5. In addition, a step is formed on a tapered surface of each of the partition walls 34 formed by the preceding full exposure, by performing the half exposure through use of the photomask B with the transmission sections P1 and P2 having the different transmittances, as in FIG. 15A. Formation of this step allows the taper angle of the partition wall 34 to become small (θ2) through a baking treatment, and prevents step disconnection of the cathode electrode 16 serving as a common electrode among the pixels which is to be formed later.

In the display 1H and the display 1I of the present embodiment, the first lyophilic regions $2A_7$ and the first liquid-repellent regions $2B_7$ are formed as the partition walls 34 by using the same material. Therefore, it is possible to form both regions in the same process. Hence, a production process is shortened, and manufacturing yield improves, as compared with the case where the first lyophilic regions 2A and the first liquid-repellent regions 2B are formed of different materials as in the first to seventh embodiments.

9. Modification

Figure 17:
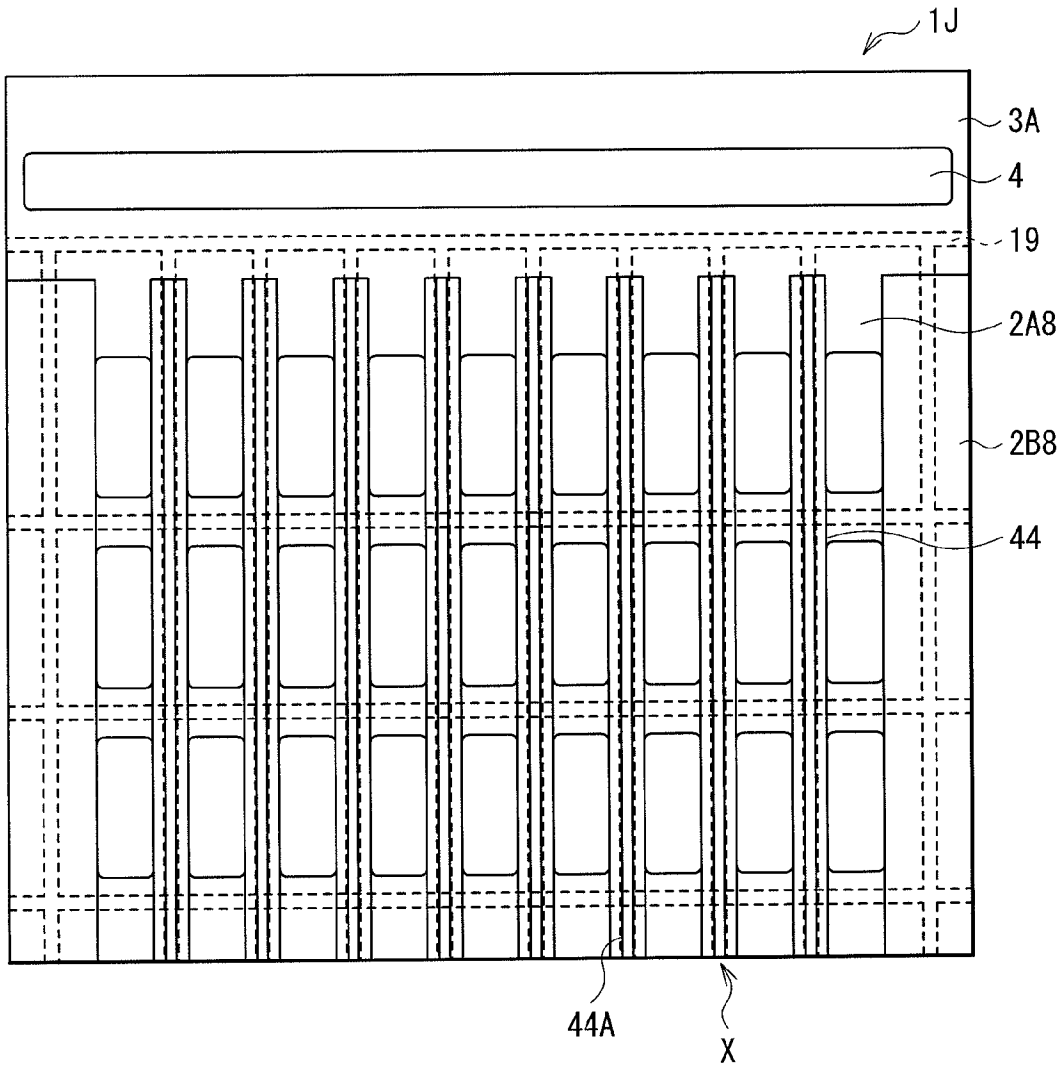
FIG. 17 is a plan view illustrating an example of a configuration of a part of a display according to a modification of the disclosure.
Figure 18:
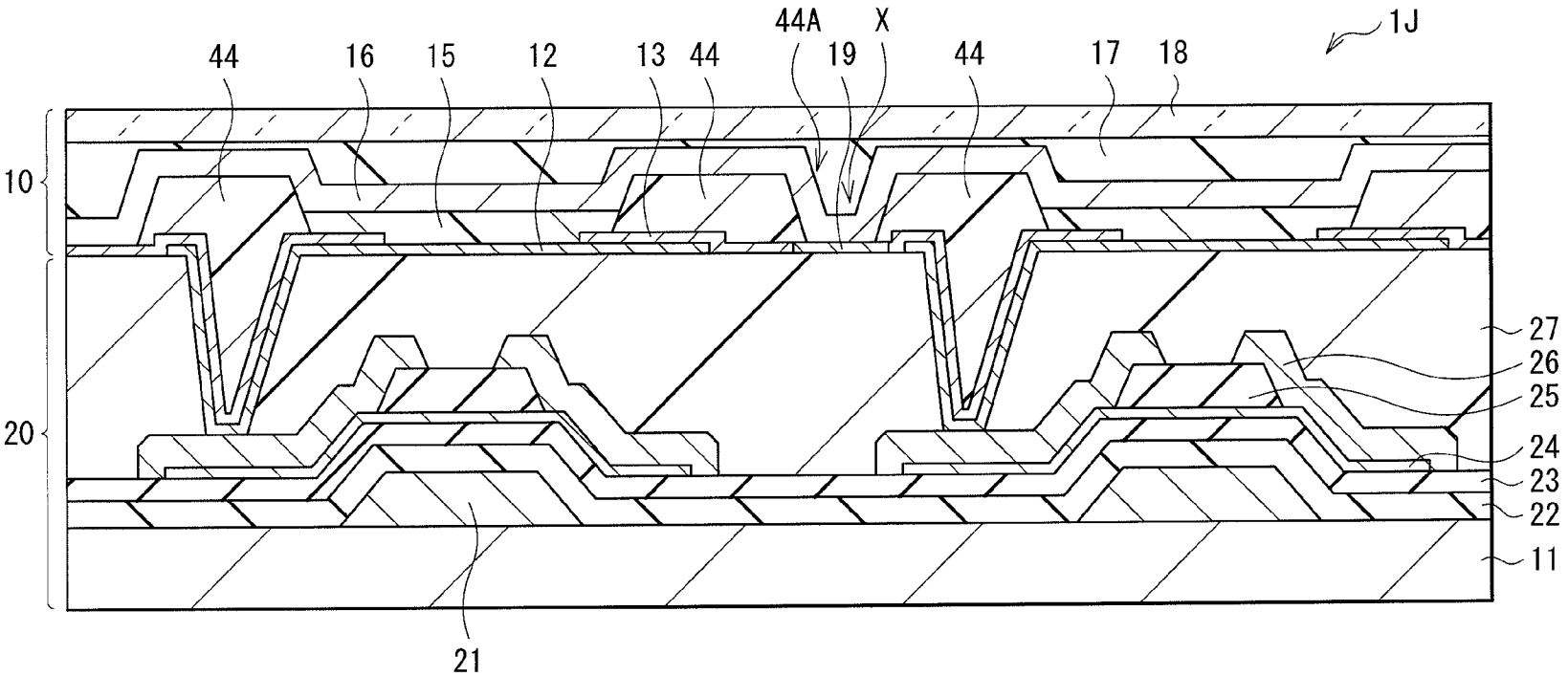
FIG. 18 is a cross-sectional diagram of the display illustrated in FIG. 17.

FIG. 17 illustrates a plane configuration of a display region 2 and a peripheral region 3 in a display 1J, according to a modification of the disclosure, and FIG. 18 illustrates a cross-sectional configuration of the display 1J. In this display 1J, a groove 44A is formed in each of partition walls 44, where pixels 5 (5R, 5G, and 5B) are provided in lines as first liquid-repellent regions $2B_8$. This groove 44A serves as a connection section X where a cathode electrode 16 and auxiliary wiring 19 (a third electrode) are electrically connected to each other. The auxiliary wiring 19 reduces contact resistance of the cathode electrode 16.

In a display having a typical configuration, a cathode electrode is connected to auxiliary wiring arranged in a column direction between pixels next to each other in a short-side direction. However, in the display 1 (1A to 1I), the ink to become the organic layer 15 is applied onto the entire surface of the first lyophilic regions 2A including each of the color pixels 5R, 5G, and 5B arranged in lines, namely, onto the auxiliary wiring 19. For this reason, the organic layer 15 lies between the auxiliary wiring 19 and the cathode electrode 16, failing to achieve good contact, which is a disadvantage.

In the present modification in contrast, the groove 44A passing through the partition wall 44 and reaching the auxiliary wiring 19 is provided in the partition wall 44 that is a first liquid-repellent region $2B_8$ below which the auxiliary wiring 19 is formed as illustrated in FIG. 17. This allows formation of the connection section X where the cathode electrode 16 and the auxiliary wiring 19 are directly in contact with each other in the groove 44A, and good connection to be ensured. The grooves 44A are formed, for example, by performing etching after formation of the partition walls 44. A taper angle (θ) of each of the partition walls 44 formed at the time is desirably about 30 degrees or more and about 40 degrees or less. It is to be noted that the connection section X between the cathode electrode 16 and the auxiliary wiring 19 is not limited to a groove shape. In addition, each of the first liquid-repellent regions $2B_8$ is not limited to a line shape as in the first embodiment, and is applicable to the shape as in each of the second to seventh embodiments. An example will be described below.

Figure 19:
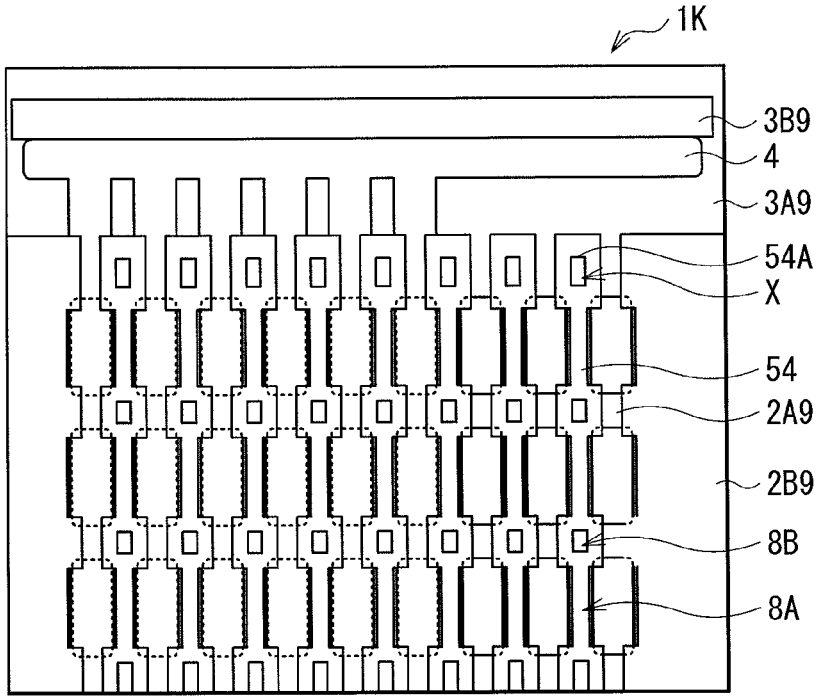
FIG. 19 is a plan view illustrating another example of the display according to the modification of the disclosure.

FIG. 19 illustrates a plane configuration of the display 1J in which the connection section X between the cathode electrode 16 and the auxiliary wiring 19 is formed at each of the projection sections 8B of the first liquid-repellent regions $2B_8$. Each of the first liquid-repellent regions $2B_5$ is patterned to be depressed at the parts adjacent to the pixels 5 and protrude at the parts not adjacent to the pixels 5 as described in the sixth embodiment. It is to be noted that here, the auxiliary wiring is omitted. When the connection section X shaped like a groove is provided in the partition wall 44 described above, it is necessary to ensure a sufficient width of the first liquid-repellent region $2B_8$, namely, the partition wall 44, thereby preventing the ink to become the organic layer 15 from entering the groove 44A. However, an increase in the width of the partition wall 44 narrows an opening region of the pixel 5, which might reduce an aperture ratio and limit a layout.

Figure 20A:
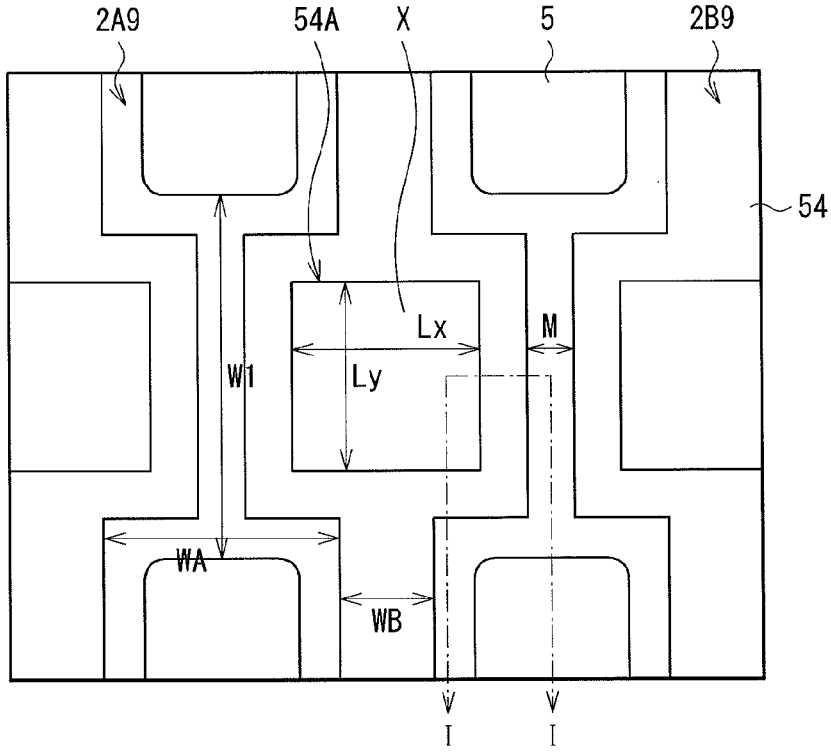
FIGS. 20A and 20B are schematic diagrams used to explain a shape of the display illustrated in FIG. 19.
Figure 20B:
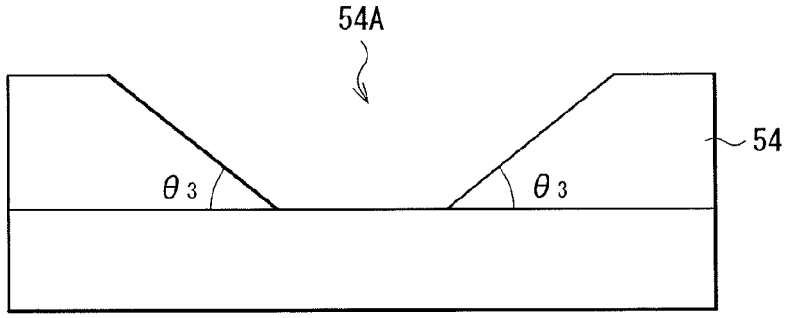

In a display 1K illustrated in FIG. 19 in contrast, in each of projection sections 8B of each of first liquid-repellent regions $2B_9$, an opening 54A passing through a partition wall 54 is provided as a connection section X between a cathode electrode 16 and auxiliary wiring 19. A size of the opening 54A is not limited in particular. For example, as illustrated in FIGS. 20A and 20B, it is assumed that a pitch is about 270 μm, a short-side length of a pixel 5 is about 54 μm, a long-side length of the pixel 5 is about 187 μm, spacing ($W_1$) between the pixels 5 in a line is about 82 μm, a width ($W_A$) of each of first lyophilic regions $2A_9$ is about 74 μm, a width ($W_B$) of each of first liquid-repellent regions $2B_9$ is about 16 μm. In this case, one side (Lx, Ly) of the opening 54A is formed to be desirably about 8 μm or more and 62 μm or less. Further, spacing (M) between the projection sections in each of which the opening 54A is formed is preferably about 8 μm or more and 62 μm or less. It is to be noted that a taper angle (θ3, FIG. 20B) of the partition wall 54 formed by the opening 54A is desirably about 30 degrees or more and about 40 degrees, like the taper angle of the partition wall 34 in the groove 44A described above. In addition, a shape of the opening 54A is not limited to a rectangle, and may be a diamond or any circle including an oval, as long as the shape allows the contact between the cathode electrode 16 and the auxiliary wiring 19. In this way, by forming the connection section X between the cathode electrode 16 and the auxiliary wiring 19 in a part not adjacent to the pixel 5, it is possible to secure good connection between the cathode electrode 16 and the auxiliary wiring 19, while maintaining the aperture ratio of the pixel 5.

Figure 21:
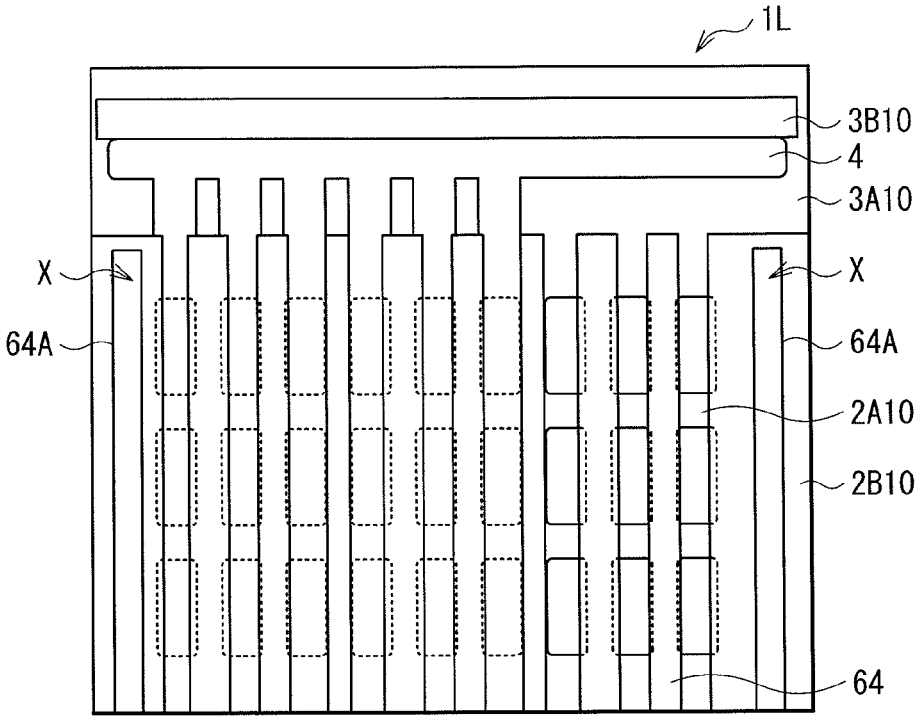
FIG. 21 is a plan view illustrating still another example of the display according to the modification of the disclosure.

FIG. 21 illustrates a plane configuration of a display 1L in which a connection section X is provided on a first liquid-repellent region $2B_{10}$ at each of both ends, among the first liquid-repellent regions $2B_{10}$ that partition pixels 5 disposed in lines. In the connection section X in each of the display 1J and the display 1K described above, there is a case where it is difficult to apply desired ink within the first lyophilic region 2A without protruding to the connection section X, depending on wettability of the ink, liquid repellency of the partition walls 44 serving as the first liquid-repellent regions 2B, an application quantity of the ink, or a designed film thickness of an applied film. The display 1L illustrated in FIG. 21 eliminates this disadvantage. Among a plurality of partition walls 64 each serving as the first liquid-repellent region $2B_{10}$, the partition wall 64 at each of both ends thereof is provided with a groove 64A, and this groove 64A serves as the connection section X between the cathode electrode 16 and the auxiliary wiring 19. This makes it possible to ensure good connection between the cathode electrode 16 and the auxiliary wiring 19, without restricting the application quantity of the ink.

In the present modification, the connection section X between the cathode electrode 16 and the auxiliary wiring 19 is provided in each of the first liquid-repellent regions $2B_8$ to $2B_{10}$ as illustrated in FIGS. 17, 19, and 21. Therefore, it is possible to keep electrical connection well between the cathode electrode 16 and the auxiliary wiring 19, without depending on a film formation method of the organic layer 15.

10. APPLICATION EXAMPLES

It is possible to mount each of the displays 1A to 1L, on an electronic unit in each of application examples 1 to 5 as follows, for example.

Module and Application Examples

The application examples of the displays 1A to 1L in the first to eighth embodiments and the modification will be described below. The displays 1A to 1L of the embodiments and the like may be applied to electronic units in all fields, which display externally-input image signals or internally-generated image signals as still or moving images. The electronic units include television receivers, digital cameras, laptop computers, portable terminals such as portable telephones, video cameras, and the like.

(Module)

Figure 22:
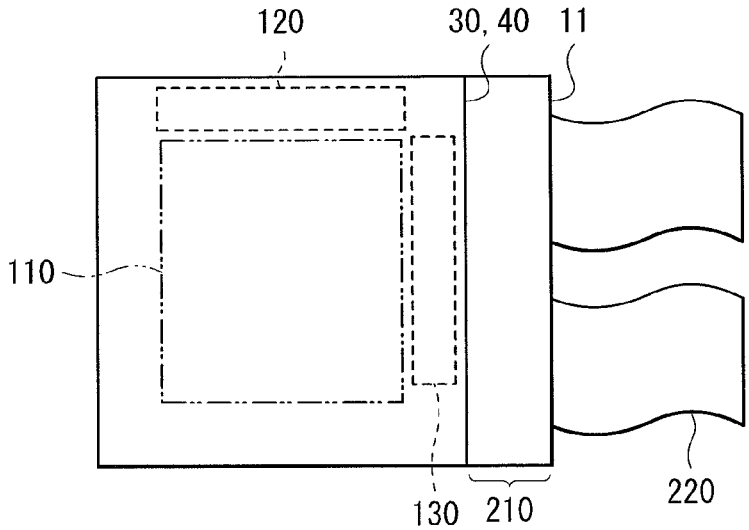
FIG. 22 is a plan view illustrating a schematic configuration of a module including the display in any of the embodiments.

Any of the displays 1A to 1L in the embodiments and the like is, for example, incorporated into any of various kinds of electronic units such as the application examples 1 to 5 to be described below, as a module illustrated in FIG. 22. This module is formed, for example, by providing a region 210 exposed at one side of the substrate 11 from a protective layer 20 and a sealing substrate 30. In this exposed region 210, an external connection terminal (not illustrated) is formed by extending wires of the signal-line driving circuit 120 and the scanning-line driving circuit 130. This external connection terminal may be provided with a flexible printed circuit (FPC) 220 for input and output of signals.

Application Example 1

FIG. 23 illustrates an external view of a television receiver to which any of the displays 1A to 1L of the embodiments and the like is applied. This television receiver has, for example, an image-display screen section 300 that includes a front panel 310 and a filter glass 320, and this image-display screen section 300 is configured using any of the displays 1A to 1L of the embodiments and the like.

Application Example 2

FIGS. 24A and 24B each illustrate an external view of a digital camera to which any of the displays 1A to 1L of the embodiments and the like is applied. This digital camera includes, for example, a flash emitting section 410, a display section 420, a menu switch 430, and a shutter release 440. The display section 420 is configured using any of the displays 1A to 1L of the embodiments and the like.

Application Example 3

Figure 25:
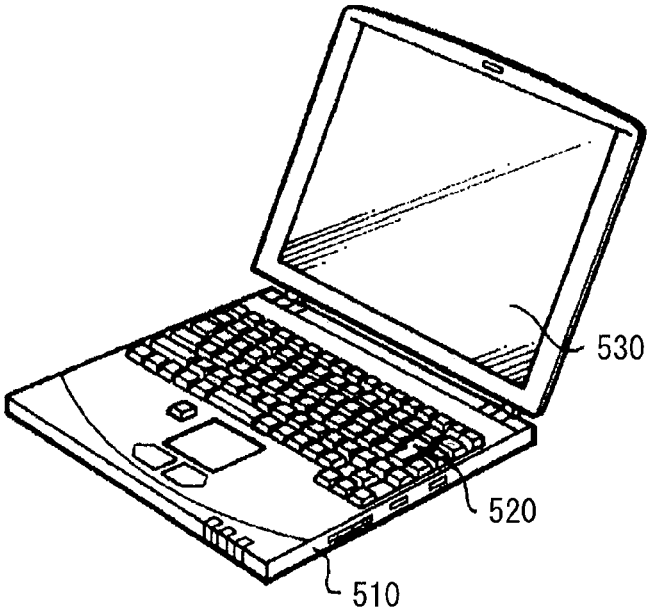
FIG. 25 is a perspective diagram illustrating an appearance of an application example 3.

FIG. 25 illustrates an external view of a laptop computer to which any of the displays 1A to 1L of the embodiments and the like is applied. This laptop computer includes, for example, a main section 510, a keyboard 520 for entering characters and the like, and a display section 530 displaying an image. The display section 530 is configured using any of the displays 1A to 1L of the embodiments and the like.

Application Example 4

Figure 26:
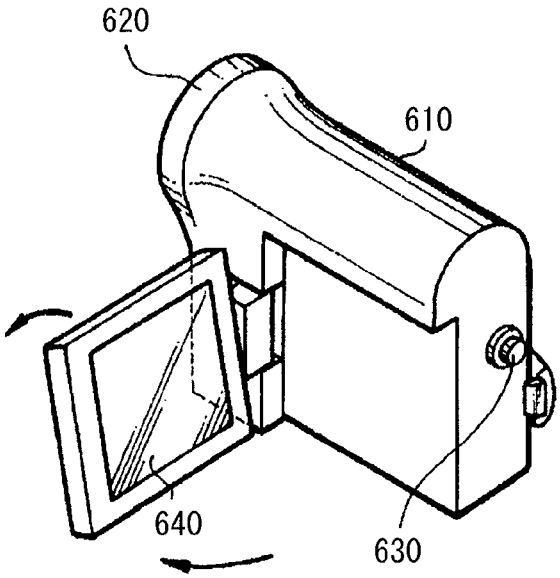
FIG. 26 is a perspective diagram illustrating an appearance of an application example 4.

FIG. 26 illustrates an external view of a video camera to which any of the displays 1A to 1L of the embodiments and the like is applied. This video camera includes, for example, a main section 610, a lens 620 disposed on a front face of this main section 610 to shoot an image of a subject, a start/stop switch 630 in shooting, and a display section 640. The display section 640 is configured using any of the displays 1A to 1L of the embodiments and the like.

Application Example 5

FIGS. 27A to 27G illustrate external views of a portable telephone to which any of the displays 1A to 1L of the embodiments and the like is applied. This portable telephone is, for example, a unit in which an upper housing 710 and a lower housing 720 are connected by a coupling section (a hinge section) 730, and includes a display 740, a sub-display 750, a picture light 760, and a camera 770. The display 740 or the sub-display 750 is configured using any of the displays 1A to 1L of the embodiments and the like.

The present technology has been described by using the first to eighth embodiments and the modification, but is not limited to these embodiments and like, and may be variously modified. For example, the first liquid-repellent regions 2B ($2B_1$ to $2B_{10}$) in the first to eighth embodiments and the modification may be combined with one another. For instance, in addition to the first lyophilic regions $2A_4$ with the widths changing along the longitudinal direction in the fifth embodiment, a narrow section may be formed at one end of the wide section as in the first lyophilic region $2A_3$ in the fourth embodiment.

Also, in the first to eighth embodiments and the modification, the first liquid-repellent regions 2B serving as the partition walls are formed using the organic material such as polyimide or novolak, but are not limited to these materials. The first liquid-repellent regions 2B may be formed using the fluorine-containing material used in the eighth embodiment.

Moreover, the material and the thickness of each layer, or the film formation method and the film formation condition described in the embodiments and the like are not limited, and may be other material and thickness, or other film formation method and film formation condition. For example, the oxide semiconductor is used as the channel in the TFT 20 in the first embodiment, although it is not limited thereto. Silicon or an organic semiconductor may be used.

It is possible to achieve at least the following configurations from the above-described exemplary embodiments and the modifications of the disclosure.

(1) A display including:

a display region including a plurality of pixels, a plurality of first liquid-repellent regions, and a plurality of first lyophilic regions, each of the plurality of first liquid-repellent regions being provided in a part or a whole of a portion between the plurality of pixels, and each of the plurality of first lyophilic regions being provided between the plurality of first liquid-repellent regions next to each other; and a peripheral region in a part or a whole of which a second lyophilic region is formed.

(2) The display according to (1), in which the plurality of pixels are arranged in a grid.

(3) The display according to (2), in which each of the first liquid-repellent regions is formed continuously in one direction, between the plurality of pixels arranged in the grid.

(4) The display according to (1), in which a width of each of the first liquid-repellent regions changes along a longitudinal direction.

(5) The display according to (1), in which a projection section or a depression section is formed in a region of each of the first liquid-repellent regions, the region corresponding to each of the pixels.

(6) The display according to (1), in which the plurality of pixels are classified into two or more colors, and a space between the plurality of first liquid-repellent regions is different for each color.

(7) The display according to (1), in which each of the first lyophilic regions and the second lyophilic region are continuous with each other.

(8) The display according to (1), in which a wide section is provided in the first lyophilic regions at one end of the first liquid-repellent regions next to each other, and a narrow region is formed in the wide section.

(9) The display according to (1), in which one or more organic layers are formed in each of the first lyophilic regions.

(10) The display according to (9), in which a surface of each of the organic layers formed in each of the first lyophilic regions is in a lyophilic state.

(11) The display according to (1), in which a second liquid-repellent region is formed in a part or a whole of the peripheral region.

(12) The display according to (11), in which the second liquid-repellent region is provided between a wiring section provided in the peripheral region and an organic layer.

(13) The display according to (12), in which the first lyophilic regions and the second lyophilic region are each formed of a layer made of an inorganic material, and the first liquid-repellent regions and the second liquid-repellent region are each formed of a layer made of an organic material, the organic material being made to be lyophilic by a plasma treatment.

(14) The display according to (13), in which the inorganic material is silicon dioxide ($SiO_2$), silicon carbide (SiC), silicon nitride ($Si_3N_4$), indium tin oxide (ITO), indium zinc oxide (IZO), aluminum (Al), titanium (Ti), or molybdenum (Mo).

(15) The display according to (13), in which the organic material is polyimide or novolak.

(16) The display according to (1), in which a partition wall made of a fluorine-containing material is provided around each of the pixels, each of the first liquid-repellent regions is a top face of the partition wall, and each of the first lyophilic regions is a side face of the partition wall.

(17) The display according to (16), in which the partition wall has a taper shape, and a taper angle in a long-side direction of the pixels is greater than a taper angle in a short-side direction of the pixels.

(18) The display according to (1), in which each of the pixels includes a first electrode, a second electrode, and a third electrode, the first electrode and the second electrode each applying a predetermined voltage to a light-emitting layer, and the third electrode reducing a wiring resistance of the second electrode, and a connection section between the second electrode and the third electrode is provided within each of the first liquid-repellent regions.

(19) The display according to (18), in which the connection section is provided continuously in one direction within a part or a whole of each of the first liquid-repellent regions.

(20) The display according to (18), in which the connection section is provided in a part or a whole of each of a plurality of projection sections in each of the first liquid-repellent regions.

(21) An electronic unit including a display, the display including:

a display region including a plurality of pixels, a plurality of first liquid-repellent regions, and a plurality of first lyophilic regions, each of the plurality of first liquid-repellent regions being provided in a part or a whole of a portion between the plurality of pixels, and each of the plurality of first lyophilic regions being provided between the plurality of first liquid-repellent regions next to each other; and a peripheral region in a part or a whole of which a second lyophilic region is formed.

The present disclosure contains subject matter related to that disclosed in Japanese Priority Patent Application JP 2011-112381 filed in the Japan Patent Office on May 19, 2011 and Japanese Priority Patent Application JP 2012-035312 filed in the Japan Patent Office on Feb. 12, 2012, the entire content of which is hereby incorporated by reference.

It may be understood by those skilled in the art that various modifications, combinations, sub-combinations and alterations may occur depending on design requirements and other factors insofar as they are within the scope of the appended claims or the equivalents thereof.

What is claimed is:

1. A display comprising:

a display region including a plurality of pixels, a plurality of first liquid-repellent regions, and a plurality of first lyophilic regions, each of the plurality of first liquid-repellent regions being provided in a part or a whole of a portion between the plurality of pixels, and each of the plurality of first lyophilic regions being provided between the plurality of first liquid-repellent regions next to each other; and a peripheral region in a part or a whole of which a second lyophilic region is formed.

2. The display according to claim 1, wherein the plurality of pixels are arranged in a grid.

3. The display according to claim 2, wherein each of the first liquid-repellent regions is formed continuously in one direction, between the plurality of pixels arranged in the grid.

4. The display according to claim 1, wherein a width of each of the first liquid-repellent regions changes along a longitudinal direction.

5. The display according to claim 1, wherein a projection section or a depression section is formed in a region of each of the first liquid-repellent regions, the region corresponding to each of the pixels.

6. The display according to claim 1, wherein the plurality of pixels are classified into two or more colors, and a space between the plurality of first liquid-repellent regions is different for each color.

7. The display according to claim 1, wherein each of the first lyophilic regions and the second lyophilic region are continuous with each other.

8. The display according to claim 1, wherein a wide section is provided in the first lyophilic regions at one end of the first liquid-repellent regions next to each other, and a narrow region is formed in the wide section.

9. The display according to claim 1, wherein one or more organic layers are formed in each of the first lyophilic regions.

10. The display according to claim 9, wherein a surface of each of the organic layers formed in each of the first lyophilic regions is in a lyophilic state.

11. The display according to claim 1, wherein a second liquid-repellent region is formed in a part or a whole of the peripheral region.

12. The display according to claim 11, wherein the second liquid-repellent region is provided between a wiring section provided in the peripheral region and an organic layer.

13. The display according to claim 12, wherein the first lyophilic regions and the second lyophilic region are each formed of a layer made of an inorganic material, and the first liquid-repellent regions and the second liquid-repellent region are each formed of a layer made of an organic material, the organic material being made to be lyophilic by a plasma treatment.

14. The display according to claim 13, wherein the inorganic material is silicon dioxide ($SiO_2$), silicon carbide (SiC), silicon nitride ($Si_3N_4$), indium tin oxide (ITO), indium zinc oxide (IZO), aluminum (Al), titanium (Ti), or molybdenum (Mo).

15. The display according to claim 13, wherein the organic material is polyimide or novolak.

16. The display according to claim 1, wherein a partition wall made of a fluorine-containing material is provided around each of the pixels, each of the first liquid-repellent regions is a top face of the partition wall, and each of the first lyophilic regions is a side face of the partition wall.

17. The display according to claim 16, wherein the partition wall has a taper shape, and a taper angle in a long-side direction of the pixels is greater than a taper angle in a short-side direction of the pixels.

18. The display according to claim 1, wherein each of the pixels includes a first electrode, a second electrode, and a third electrode, the first electrode and the second electrode each applying a predetermined voltage to a light-emitting layer, and the third electrode reducing a wiring resistance of the second electrode, and a connection section between the second electrode and the third electrode is provided within each of the first liquid-repellent regions.

19. The display according to claim 18, wherein the connection section is provided in a part or a whole of each of a plurality of projection sections in each of the first liquid-repellent regions.

20. An electronic unit including a display, the display comprising:

a display region including a plurality of pixels, a plurality of first liquid-repellent regions, and a plurality of first lyophilic regions, each of the plurality of first liquid-repellent regions being provided in a part or a whole of a portion between the plurality of pixels, and each of the plurality of first lyophilic regions being provided between the plurality of first liquid-repellent regions next to each other; and a peripheral region in a part or a whole of which a second lyophilic region is formed.

* * * * *